US007242357B2

(12) United States Patent
Fujii et al.

(10) Patent No.: US 7,242,357 B2
(45) Date of Patent: Jul. 10, 2007

(54) ANTENNA FOR VEHICLE

(75) Inventors: Hiroyuki Fujii, Matsusaka (JP); Masashi Uemura, Matsusaka (JP)

(73) Assignee: Central Glass Co., Ltd., Yamaguchi (JP)

( * ) Notice: Subject to any disclaimer, the term of this patent is extended or adjusted under 35 U.S.C. 154(b) by 0 days.

(21) Appl. No.: 10/549,803

(22) PCT Filed: Mar. 16, 2004

(86) PCT No.: PCT/JP2004/003490

§ 371 (c)(1),
(2), (4) Date: Sep. 19, 2005

(87) PCT Pub. No.: WO2004/084343

PCT Pub. Date: Sep. 30, 2004

(65) Prior Publication Data

US 2006/0176227 A1 Aug. 10, 2006

(30) Foreign Application Priority Data

| | | |
|---|---|---|
| Mar. 19, 2003 | (JP) | 2003-074837 |
| Nov. 25, 2003 | (JP) | 2003-394328 |
| Jan. 14, 2004 | (JP) | 2004-007353 |
| Feb. 9, 2004 | (JP) | 2004-032659 |

(51) Int. Cl.
*H01Q 1/32* (2006.01)

(52) U.S. Cl. ..... 343/713; 343/711

(58) Field of Classification Search ..... 343/703, 343/711, 712, 704, 713
See application file for complete search history.

(56) References Cited

U.S. PATENT DOCUMENTS

| | | | | |
|---|---|---|---|---|
| 3,771,159 | A * | 11/1973 | Kawaguchi et al. | 343/729 |
| 5,793,333 | A * | 8/1998 | Taniguchi et al. | 343/713 |
| 6,943,741 | B2 * | 9/2005 | Bally et al. | 343/713 |

FOREIGN PATENT DOCUMENTS

| | | |
|---|---|---|
| JP | 06-152216 | 5/1994 |
| JP | 06-276008 | 9/1994 |
| JP | 06-291531 | 10/1994 |
| JP | 06-314921 | 11/1994 |
| JP | 07-122920 | 5/1995 |
| JP | 07-263934 | 10/1995 |
| JP | 08-148921 | 6/1996 |
| JP | 10-261911 | 9/1998 |
| JP | 2001-119223 | 4/2001 |
| JP | 2001-332923 | 11/2001 |
| JP | 2003-273625 | 9/2003 |

* cited by examiner

*Primary Examiner*—Hoanganh Le
(74) *Attorney, Agent, or Firm*—Young & Thompson

(57) ABSTRACT

An antenna for vehicle, i.e. a wire antenna being arranged on the surface of the window glass of an automobile or the like, comprising a first element having a length extending from a first feeding point equal to any one of ¼, ¾ or 5/4 of the wavelength of a transmitting/receiving radio wave, and a second closed loop element having a length extending from a second feeding point, provided in the vicinity of the first feeding point, while surrounding the first element not shorter than one wavelength of the transmitting/receiving radio wave.

19 Claims, 17 Drawing Sheets

ANTENNA FOR VEHICLE

TECHNICAL FIELD

The present invention relates to a line antenna provided on the surface of a window glass or the surface of an insulating member of a movable body such as a vehicle, which is preferable for use in receiving FM radio broadcast waves, digital radio broadcast waves and television broadcast waves, as well as in transmitting and receiving radio waves of very-high-frequency range or higher such as of car telephones, portable telephones, personal radio communication equipment, commercial radio communication equipment and PHS (Personal Handy Phone System).

BACKGROUND ART

Conventionally, while rod antennas have been widely used as antennas for transmitting and receiving radio waves of car telephones and portable telephones and receiving television broadcast waves, since the construction of these rod antennas requires them to protrude from the vehicle body, there have been caused drawbacks that the protrusion of the antennas is not preferable from safety and aesthetic appearance aspects and that the protruding antenna constitutes a disturbance and may be broken when washing a vehicle.

Due to this, in recent years, there have been demands for antennas with no protrusion such as glass antennas in which an antenna pattern is directly printed on a window glass of a vehicle and antennas in which a seal or sheet on which an antenna pattern is printed is affixed to a window glass of a vehicle, and those antennas have now been put to practical use.

Some of such glass antennas and seal antennas which are now in practical use as car and portable telephone antennas have practically the same transmission and reception gain performance as that of rod antennas.

For example, JP-A-06-152216 discloses a glass antenna for car telephones which is characterized by the inclusion of a radiation pattern whose length in a vertical direction on the surface of a window glass is approximately ¼ of the wavelength and a ground pattern whose length in a horizontal direction on the surface of the window glass is approximately ¼ of the wavelength, wherein the ground pattern is provided on at least one of left and right ends of the window glass surface in such a manner that when the ground pattern is provided on the left end, the radiation pattern is provided so as to be close to a left-hand side portion of the ground pattern, whereas when the ground pattern is provided on the right end, the radiation pattern is provided so as to be close to a right-hand side portion of the ground pattern, so that the ground pattern is formed into a ring-like shape (Patent Document No. 1).

In addition, JP-A-06-314921 discloses a glass antenna provided on a vehicular window glass which is characterized by the inclusion of at least a first element in which a horizontal line is connected to a distal end of a vertical line and a second element in which a horizontal line connected to a distal end of a vertical line and another horizontal line are provided so as to be close to each other vertically in such a manner as to hold the horizontal line of the first element therebetween, so that an end portion of the first element is encompassed by the two horizontal lines (Patent Document No. 2).

Furthermore, JP-A-08-148921 discloses a glass antenna system for car telephones formed by using a conductor pattern on a vehicle window glass which is characterized by being made up of a circular radiation pattern and a doughnut-like shaped ground pattern provided concentrically on an outside of the radiation pattern (Patent Document No. 3).

On the other hand, glass antennas which are now in practical use as vehicular glass antennas for reception of television broadcast waves have practically the same reception performance and gain as those of rod antennas and are disclosed.

For example, JP-A-07-263934 discloses a vehicular glass antenna provided on an upper unused portion on a vehicular rear window glass in which a defogging heater line is embedded which is characterized by the inclusion of a first antenna made up of a horizontal line and a vertical line and a second antenna provided in an unused portion of the first antenna in a left half or right half of the rear window glass in which a line is provided to extend perpendicularly from part of a main element mainly made up of a horizontal line, a transversely elongated rectangular element is connected to the perpendicularly extending line, and a line is drawn out of part of a short side of the rectangular element for implementing a feeding at the side portion of the element (Patent Document No. 4).

In addition, JP-A-2001-119223 discloses a glass antenna provided on a vehicular side window for preferably receiving, in particular, TV radio waves of all bands (Patent Document No. 5).

Furthermore, JP-A-2001-332923 discloses a film antenna in which a rectangular flat plate-like film antenna element is provided on a glass supported by a conductive frame unit for preferably receiving TV radio waves of all bands (Patent Document No. 6).

(Patent Document No. 1) JP-A-06-152216
(Patent Document No. 2) JP-A-06-314921
(Patent Document No. 3) JP-A-08-148921
(Patent Document No. 4) JP-A-07-263934
(Patent Document No. 5) JP-A-2001-119223
(Patent Document No. 6) JP-A-2001-332923

However, since the antenna performance of any of the car telephone or portable telephone glass antennas shown in Patent Document No 1 to Patent Document No. 3 and the TV broadcast waves reception glass antennas shown in Patent Document No. 4 to Patent document No. 6 is liable to be affected by locations where the antenna is placed or structures in the vicinity of the antenna so placed, antenna elements and antenna setting positions must be adjusted vehicle by vehicle. Further, even in case such adjustments are carried out accordingly, the antenna performance has still been changed by the effect of human bodies.

In addition, the car telephone or portable telephone glass antennas shown in Patent Document No. 1 to Patent Document No. 6 have low gains compared with the rod antennas, and hence a further improvement in antenna gain has been desired. Furthermore, as to the TV broadcast waves reception glass antennas shown in Patent Document No. 4 to Patent Document No. 6, not only does a grounding need to be provided in the vicinity of an antenna feeding point but also antenna setting conditions are limited with respect to reception frequencies. In particular, the antenna has to be provided limitedly on the rear window of the vehicle in Patent Document No. 4, on a side window of the vehicle in Patent Document No. 5 and on a large window or door of a structure such as a building in Patent Document No. 6.

In particular, as to the TV broadcast waves reception antennas shown in Patent Document No. 4 to Patent Document No. 5, it was difficult to match the impedance of the antenna to the impedance of the receiver over all the bands of TV broadcast waves to be received.

The invention was made in view of the problems, and an object thereof is to provide a vehicular antenna which can make it difficult for the antenna performance thereof to be affected by antenna setting locations and human bodies so as to reduce an actual antenna area while increasing the antenna performance higher than that provided by the conventional techniques and is hence preferable as a car telephone and portable telephone antenna, as well as a digital broadcast waves and TV broadcast waves reception antenna, which can, furthermore, transmit and receive radio waves of personal radio communication equipment, commercial radio communication equipment and PHS, and which can, moreover, be made difficult to be bound by a position on the surface of a window glass where the antenna is provided.

DISCLOSURE OF THE INVENTION

Namely, according to the invention, there is provided a vehicular antenna which is a line antenna provided on a surface of a window glass or a surface of an insulating member of a movable body such as a vehicle, provided with a first element which is extended from a first feeding point and which has a length of either ¼, ¾ or ⅝ of the wavelength of radio wave to be transmitted and received and a second element formed into a closed loop which is extended from a second feeding point which is provided in the vicinity of the first feeding point in such a manner as to surround the first element and which has a length equal to or greater than one wavelength of the transmission and reception radio wave.

Alternatively, according to the invention, there is provided a vehicular antenna as set forth above, in which a linear portion which is extended from the first feeding point of the first element includes a first linear portion which extends close to a closed loop line of the second element with a length of ⅛ or shorter of the wavelength of the transmission and reception radio wave for a capacity coupling and a second linear portion which is extended from a distal end of the first linear portion in a direction in which the second linear portion extends away therefrom.

In additions alternatively, according to the invention, there is provided a vehicular antenna as set forth above, in which a portion which is spaced apart along a linear portion extended from the second feeding point of the second element by ¼ of the wavelength of the transmission and reception radio wave is provided 1/32 or longer of the wavelength apart from an opposite end portion to the first feeding point of the first element.

In addition, alternatively, according to the invention, there is provided a vehicular antenna as set forth in any of the above vehicular antennas, in which a feeding point for the second element formed into the closed loop is provided at a distal end of a leading line along the closed loop, the length of the leading line being made to be ¼ or shorter of the wavelength of the transmission and reception radio wave.

In addition, alternatively, according to the invention, there is provided a vehicular antenna as set forth in any of the vehicular antennas, in which, instead of placing the first feeding point and the second feeding point close to each other, a metallic terminal is placed on at least either of the first feeding point and the second feeding point, so that either the feeding point or the metallic terminal of either of the first feeding point and the second feeding point becomes close to either the feeding point or the metallic terminal of the other.

In addition, alternatively, according to the invention, there is provided a vehicular antenna as set forth in any of the vehicular antennas, in which the first linear portion which extends from the first feeding point of the first element with the length of ⅛ or shorter of the wavelength of the transmission and reception radio wave becomes close to the second element with a spacing of 0.1 to 10 mm.

In addition, alternatively, according to the invention, there is provided a vehicular antenna as set forth in any of the vehicular antennas, in which the length of the closed loop linear portion of the second element is equal to or longer than one wavelength of the transmission and reception radio wave but not in excess of four wavelengths.

In addition, alternatively, according to the invention, there is provided a vehicular antenna as set forth above, in which the length of the closed loop linear portion of the second element is $(1+n/2)\lambda$ (n is an integer of 0 to 6), assuming that the wavelength of the transmission and reception radio wave is $\lambda$.

In addition, alternatively, according to the invention, there is provided a vehicular antenna as set forth in any of the vehicular antennas, in which first elements are provided at a plurality of locations inside the second element formed into the closed loop in such a manner that respective first feeding points of the plurality of first elements are positioned in the vicinity of the second feeding point of the second element.

According to the invention, there is provided a vehicular antenna as set forth in any of the vehicular antennas, in which the second element is formed into a closed loop of a polygonal or arc-like shape.

Alternatively, according to the invention, there is provided a vehicular antenna as set forth above, in which a spacing between the first element and the second element at a portion linearly extended from the first feeding point by a length of ½ of the wavelength of the transmission and reception radio wave is 0.5 to 10 mm, when the length of the first element is ¾ of the wavelength of the transmission and reception radio wave.

In addition, alternatively, according to the invention, there is provided a vehicular antenna as set forth above, in which a spacing between the first element and the second element at a portion linearly extended from the first feeding point by a length equal to one wavelength of the transmission and reception radio wave is 0.5 to 10 mm, when the length of the first element is ⅝ of the wavelength of the transmission and reception radio wave.

In addition, alternatively, according to the invention, there is provided a vehicular antenna as set forth in any of the vehicular antennas, in which the length of the second element is increased by ¼ or greater of the wavelength of the transmission and reception radio wave over the length of the first element.

In addition, alternatively, according to the invention, there is provided a vehicular antenna as set forth in any of the vehicular antennas, in which the length of the second element is $(1+n/2)\lambda$ (n is an integer of 0 to 4), assuming that the wavelength of the transmission and reception radio wave is $\lambda$.

In addition, alternatively, according to the invention, there is provided a vehicular antenna as set forth in any of the vehicular antennas, in which pattern of the antenna element is directly printed on using a conductive ceramic paste or the like or a seal or sheet on which the pattern is so printed is securely affixed to a surface made up of a window glass or the surface of an insulating member of a movable body such as a vehicle.

According to the invention, the antenna can make it difficult for the antenna performance thereof to be affected by antenna setting locations or human bodies, and hence the actual antenna area can be reduced.

In addition, the antenna can increase the antenna performance higher than that provided by the conventional techniques and is hence preferable as a car telephone and portable telephone antenna, as well as a digital broadcast waves and TV broadcast waves reception antenna and furthermore can transmit and receive radio waves of personal radio communication equipment, commercial radio communication equipment and PHS.

Furthermore, the antenna can be provided which is difficult to be affected by the position on the surface of the window glass where the antenna is provided.

Moreover, the invention can provide the antenna which is simple and compact in configuration and which has a high performance.

In particular, the simple and high-performance antenna can be provided for digital TV broadcast and telematics.

In addition, since the invention can be applied to not only the glass antenna which is directly printed on the passenger compartment side of the window glass of the vehicle but also the so-called seal antenna which is printed on the thin film-like seal or sheet so as to be securely affixed to the surface of the glass window or the insulating member of the movable body, the attachment to the vehicle can be facilitated.

Figure 1:
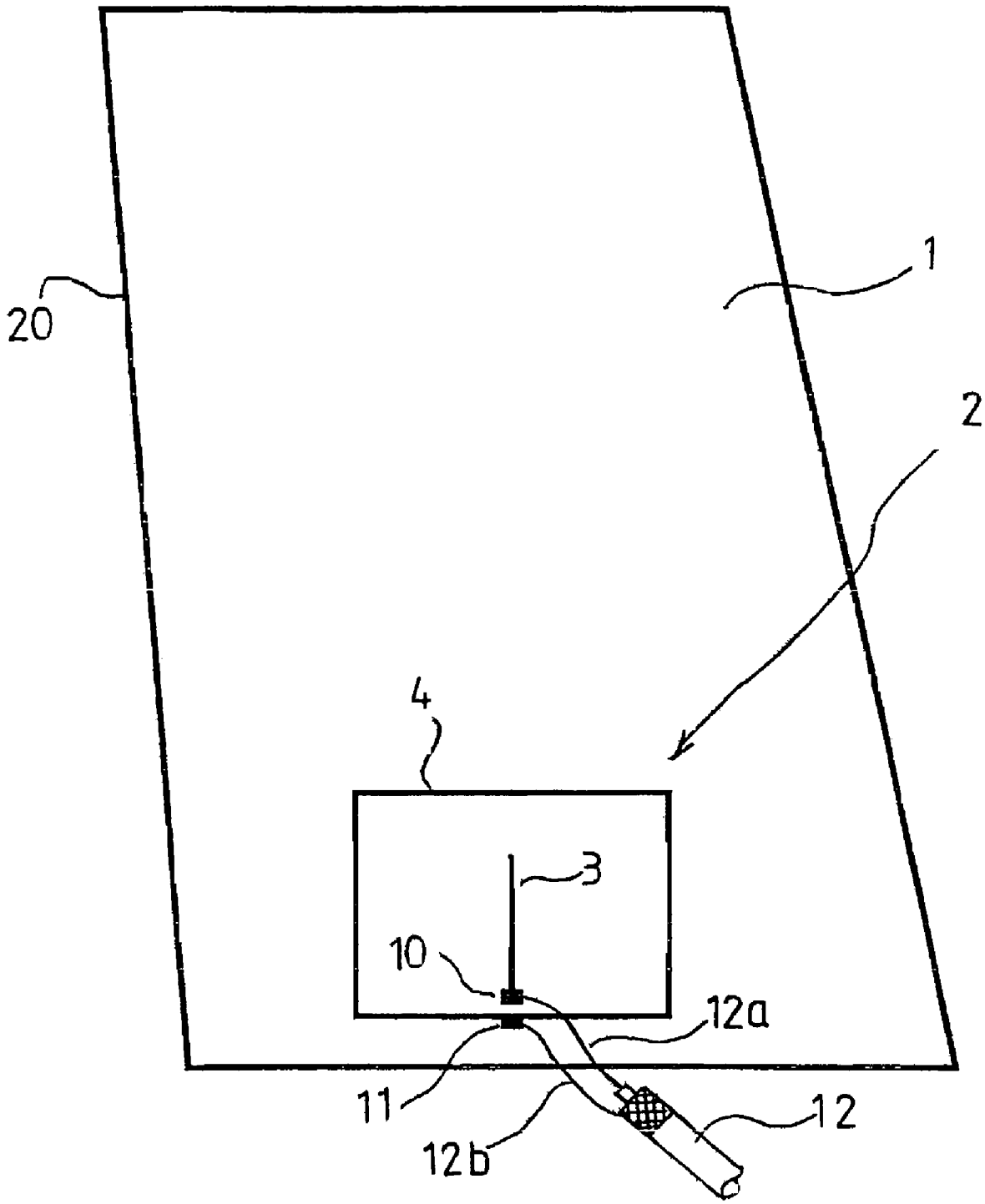
FIG. 1 is a front view of a glass antenna of the invention which is provided on a vehicle side window glass.

Note that in the figures, reference numerals 1, 101 denote window glassed, 2, 102 antennas of the invention, 3, 3', 103 first elements, 3*a*, 3'*a* first linear portions, 3*b*, 3'*b* second linear portions, 4, 4', 104 second elements, 4*a* a leading line, 4*b* closed loop linear portion, 10, 10', 110 first feeding points, 11, 11', 111 second feeding points, 12, 112 coaxial cables, 12*a*, 112*a* internal conductor lines, 12*b*, 112*b* external conductor lines, 20, 120 metallic brushes, 21, 121 metallic terminals, and 105 an auxiliary line.

BEST MODE FOR CARRYING OUT THE INVENTION

Hereinafter, a mode for carrying out the invention will described.

A first element 3, whose length is ¼ or ¾ of a wavelength of a transmission and reception radio wave, is provided from a first feeding point 10, a second feeding point 11 is provided in the vicinity of the first feeding point 10. A second element 4, which has a length equal to or longer than one wavelength of the transmission and reception radio wave and which is formed into something like a closed loop, is provided from the second feeding point 11 in such a manner as to surround the first element 3. An internal conductor line 12*a* and an external conductor line 12*b* of a coaxial cable 12 are connected, respectively, to the first feeding point 10 and the second feeding point 11.

As shown in FIGS. 12, 13, 15 and 16, the first element 10 is made up of a first linear portion 3*a* which is made up of, in turn, a linear portion extended from the first feeding point 10 in such a manner as to be kept close to a closed loop line of the second element 4 for a capacity coupling and a second linear portion 3*b* which is extended from a distal end of the first linear portion 3*a* to thereby by provided in a direction in which the second linear portion 3*b* extends away from the second element 4. The length of the first linear portion 3*a* is preferably ⅛ or shorter of the wavelength of the transmission and reception radio wave. While substantially L-shaped configurations as shown in FIGS. 12, 13, 15 and 16 are shown as shapes resulting from the connection of the first linear portion 3*a* and the second linear portion 3*b*, the first linear portion 3*a* and the second linear portion 3*b* do not always have to be formed into such linear shapes but may be formed into arc-like shapes.

On the other hand, in patterns shown in FIGS. 1 to 7 and FIG. 14, the first element 3 is formed into patterns in which the length of the first linear portion 3*a* extended from the first feeding point 10 is made zero and the entirety of a line extended from a connecting portion with the first feeding point 10 is provided in such a manner as to extend away from the closed loop line of the second element 4 or may be formed into a line having a shape in which the line so extended extends in any of perpendicular, horizontal and oblique directions, is bent into a crank- or hook-like shape, or extends in an arc-like shape.

In addition, a portion which is positioned apart from the second feeding point along the second element 4 by a length equal to ¼ of the wavelength of the transmission and reception radio wave is preferably provided 1/32 or greater of the wavelength of the transmission and reception radio wave apart from an opposite end portion of the first element 3 to the first feeding point.

Furthermore, the second element 4 has the closed loop shape, and an outer pattern shape surrounded by the closed loop may take an arbitrary shape such as a substantially rhombic shape, a substantially rectangular shape, a substantially circular shape and an L-like shape and can be changed freely depending on positions where the second element 4 is attached.

Figure 14:
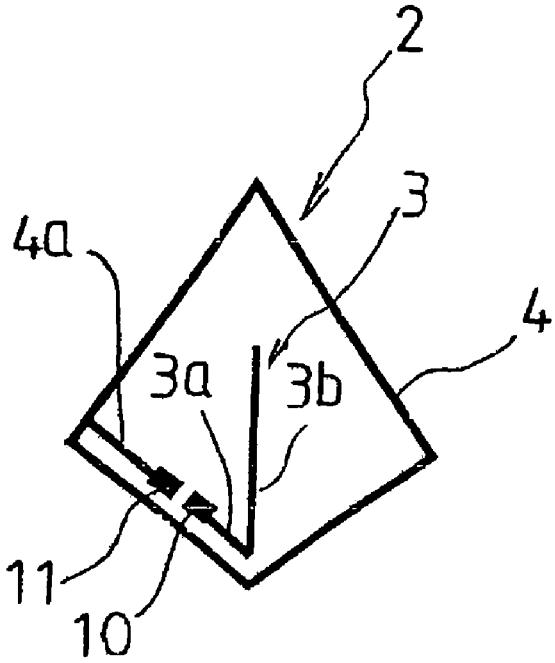
FIG. 14 is a main part detailed front view showing an antenna portion of Example 9 of the invention.
Figure 15:
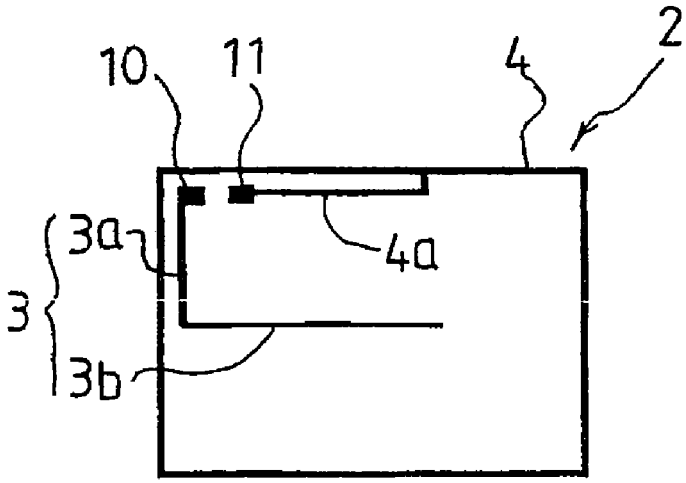
FIG. 15 is a main part detailed front view showing an antenna portion of Example 10 of the invention.

Furthermore, as shown in FIGS. 14, 15, the second element 4 may be connected to the closed loop of the second element 4 from a distal end thereof via a leading line 4*a* which is drawn from the feeding point 11 along the closed loop, and as this occurs, the length of the leading line 4*a* may be ¼ or shorter of the wavelength of the transmission and reception radio wave.

In addition, instead of placing the first feeding point and the second feeding point close to each other, a metallic terminal may be placed on at least one of the first feeding point and the second feeding point, so that either the feeding point or the metallic terminal of one of the first and second feeding points becomes close to either the feeding point or the metallic terminal of the other.

Namely, in place of the second feeding point 11 which is provided in the vicinity of the first feeding point 10 as shown in FIGS. 12 to 15, a terminal metallic fixture portion of a metallic terminal 21 which is placed on the second feeding point 11 so as to be connected and fixed thereto may be provided in such a manner as to become close to the first feeding point 10.

Note that the first linear portion 3*a*, which is extended from the first feeding point 10 of the first element 3 with the length of one eighth or shorter of the wavelength of the transmission and reception radio wave, is desirably close to a closed loop linear portion 4*b* of the second element 4 with a spacing in the range of 0.1 to 10 mm.

In addition, while the length of the closed loop linear portion 4*b* of the second element 4 is desirable to fall within a range which is equal to or greater than one wavelength of the transmission and reception radio wave but not in excess of four wavelengths from the aspect of reception characteristic, in the event that the length of the closed loop linear portion of the second element is $(1+n/2)\lambda$ (n is an integer of 0 to 6), a good reception characteristic can be obtained.

As the vehicle window glass on which the antenna is to be provided, the antenna may be provided on any of window glasses of the vehicle such as windshield glass, rear window glass, and sunroof glass, and the window glasses include not only a sheet glass but also a transparent sheet resin or a composite unit made of the glass sheet and the transparent sheet resin.

In addition, while in many cases, the movable body is normally made of metal, in the event that roof, rear door and/or part of other members thereof are made up of insulating members such as those made of resin, and as to insulating members made of resin such as bumpers and spoilers, the glass antenna 2 of the invention can be provided on these insulating members.

In addition, the antenna may be such that the antenna pattern is directly printed using a conductive paste on the surface of a window glass 1 or a member of the body which is made of the insulating material, or a seal or sheet on which the antenna pattern is printed is securely affixed to the location of the body which is made of the insulating material.

In addition, while the antenna 2 may be such as to be provided only at a single location, in the event that the antenna 2 is provided at a plurality of locations, a diversity reception can be realized. As this occurs, the patterns of the antennas so provided may be the same or different.

In addition, the first element 3 may be provided at a plurality of locations within the closed loop second element 4. The patterns of the first element 3 so provided may be the same or different.

Furthermore, the frequency bands of the first elements 3, 3' which are provided at the plurality of locations within the second element 4 may be the same or different.

Figure 23:
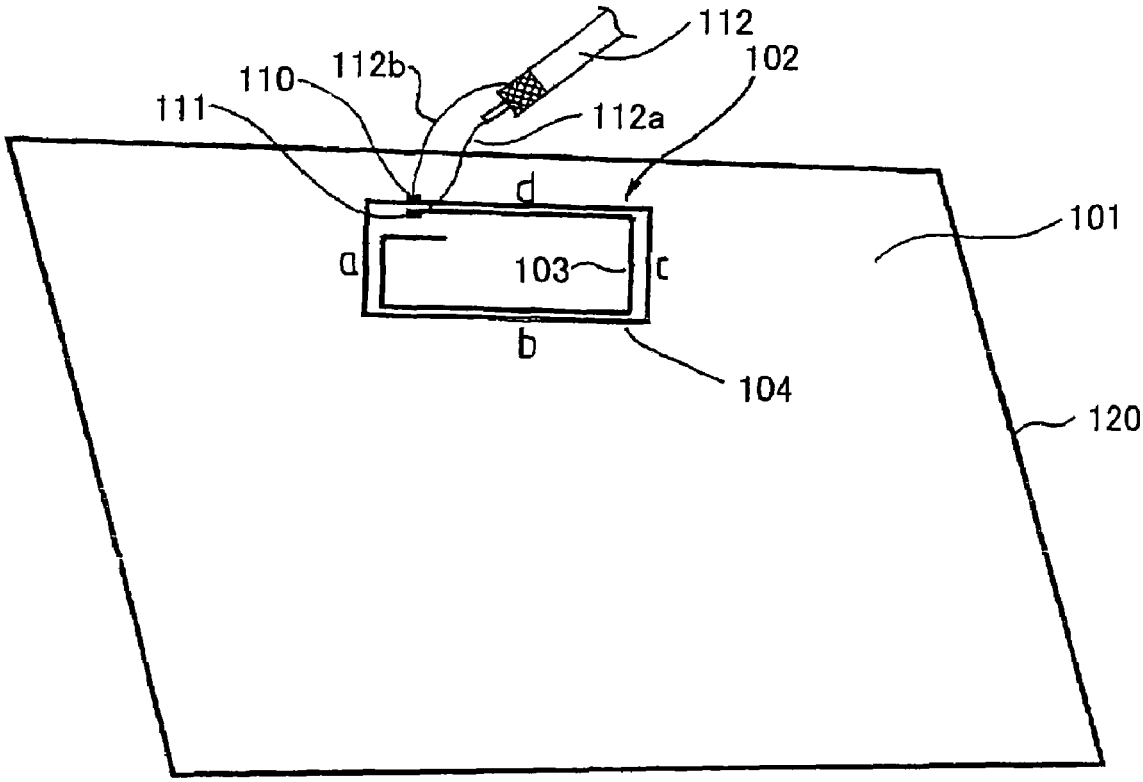
FIG. 23 is a front view of an antenna of the invention which is provided on a vehicle side window glass.

FIG. 23 shows a front view of an antenna of the invention which is provided on a vehicle side window glass.

An antenna 102 of the invention is made up of two elements which are provided on the surface of a window glass 101 of a movable body such as a vehicle or the surface of an insulating member of the movable body. The two elements are a closed loop second element 104 which is extended from a second feeding point 110 and a first element 103 which is extended from a first feeding point 111 provided within the second element 104 along the second element 104, and an external conductor line 112*b* and an internal conductor line 112*a* of a coaxial cable 112 are connected, respectively, to the second feeding point 110 and the first feeding point 111.

The second element 104 is formed into a polygonal or arc-like closed loop shape whose line length is equal to or longer than one wavelength of a radio wave to be transmitted and received and is longer than the line length of the first element.

In addition, the first element 103 is provided such that the line length thereof becomes ¾ or 5/4 of the wavelength of the transmission and reception radio wave so as to closer to an inside of the second element than the first feeding point 111 provided in the vicinity of the second feeding point inside the second element 104.

By this configuration, the area of a region surrounded by the second element 104 becomes greater than the area of a region surrounded by the first element 103, resulting in such a state that the whole area surrounded by the first element 103 is covered by the region surrounded by the second element 104.

Note that when the line length of the first element 103 is ¾ of the wavelength of the transmission and reception radio wave, a spacing between the first element and the second element at a position situated apart by a line length of one half the wavelength of the transmission and reception radio wave from the first feeding point 111 is preferably 0.5 to 10 mm.

In addition, when the line length of the first element 103 is ⅝ of the wavelength of the transmission and reception radio wave, the spacing between the first element and the second element at a position situated apart by a line length equal to one wavelength of the transmission and reception radio wave from the first feeding point 111 is preferably 0.5 to 10 mm.

In addition, the length of the second element 104 is preferably longer than the length of the first element 103 by ¼ of the wavelength of the transmission and reception radio wave.

Furthermore, an upper limit of the length of the second element 104 is $(1+n/2)\lambda$ (n is an integer of 0 to 4), assuming that the wavelength of the transmission and reception radio wave is $\lambda$.

As the vehicle window glass on which the antenna is to be provided, the antenna may be provided on any of window glasses of the vehicle such as windshield glass, rear window glass, and sunroof glass, and the window glasses include not only a sheet glass but also a transparent sheet resin or a composite unit made of the glass sheet and the transparent sheet resin.

In addition, while in many cases, the movable body is normally made of metal, in the event that roof, rear door and/or part of other members thereof are made up of insulating members such as those made of resin, and as to insulating members made of resin such as bumpers and spoilers, the glass antenna 102 of the invention can be provided on these insulating members.

In addition, the antenna may be such that the antenna pattern is directly printed using a conductive paste on the surface of a window glass 101 or a member of the body which is made of the insulating material, or a seal or sheet on which the antenna pattern is printed is securely affixed to the location of the body which is made of the insulating material.

Note that while the line widths of conductor lines of the first element and the second element are to be in the range of 0.1 to 10 mm, the line widths are preferably of the order of 0.5 to 5 mm.

In addition, while the antenna 102 may be such as to be provided only at a single location, in the event that the antenna 102 is provided at a plurality of locations, a diversity reception can be realized. As this occurs, the patterns of the antennas so provided may be the same or different.

In addition, in the event that the antenna 102 of the invention is provided on the surface of the window glass 101 of the movable body, the antenna 102 is desirably provided with a spacing of 5 mm or greater secured from the second element 104 to a flange 120 of the metallic body.

The function of the invention will be described below.

The reason why the first element 3 is desirably made to be the line whose length is ¼ or ¾ of the wave length of the transmission and reception radio wave and the second element 4 is desirably formed into the closed loop whose length is equal to or longer than one wavelength is because the size of the antenna is reduced by regarding the antenna as a grounded antenna in a pseudo fashion by making the second element 104 equal or be greater in length than one wavelength of the transmission and reception radio wave and because radio waves can be transmitted and received as efficiently as done with the grounded antenna by making the first element 3 the line whose length is ¼ or ¾ of the wavelength of the transmission and reception radio wave.

In addition, the electric field of a distal end portion of the antenna which is liable to receive external effects can be stabilized by forming the second element 4 into the closed loop shape, thereby making it possible to reduce the effect imposed by human bodies or the like.

In addition, while good results can be obtained on the first element 3 which is provided as far from the second element 4 as possible as shown in FIGS. 1 to 7, since the patterns shown in FIGS. 12, 13, 15 and 16 which are each made up of the first linear portion 3*a* which is kept close to the closed loop line of the second element 4 for capacity combination and the second linear portion 3*b* which is extended from the distal end of the first linear portion 3*a* in the direction in which the second linear portion 3*b* extends away from the second element 4 can adjust the antenna impedance, more efficient transmission and reception can be attained.

On the other hand, the first element 3 is, as shown in FIGS. 12, 13, 15 and 16, formed into the L-like shapes in which the linear portion is extend from the first feeding point 10 in such a manner that the first linear portion 3*a*, whose length is equal to one eights or shorter of the wavelength of the transmission and reception radio wave, is kept close to the second element 4 for capacity combination and the second linear portion 3*b* is extended from the distal end of the first linear portion 3*a* in the direction in which the second linear portion 3*b* extends away from the second element 4, so that the length of the second linear portion 3*b* which extends in the direction in which it extends away from the second element 4 becomes short as a result, whereby the second linear portion 3*b* and the second element 4 can be disposed to be separated apart from each other with a sufficient spacing secure therebetween, thereby making it possible to obtain a good transmission and reception performance even in the event that the length of the second element 4 is reduced.

In addition, alternatively, the reason why the portion situated apart by ¼ of the wavelength of the transmission and reception radio wave from the second feeding point 11 along the second element 4 is preferably provided apart 1/32 or greater of the wavelength of the transmission and reception radio wave from the opposite end portion to the first feeding point 10 of the first element 3 is because radio waves can be made to be transmitted as far as possible and received at as far locations as possible, and they are preferably provided as far apart from each other as possible.

In addition, while the antenna of the invention is an antenna having a broad-band performance, when the respective lengths of the linear portions of the first element 3 and the second element 4 are selected relating to an identical frequency with respect to the transmission and reception frequency, it is possible to obtain very high gain relating to the selected frequency. On the other hand, while the antenna of the invention is an antenna having a broad-band performance, by selecting lengths of the respective lines of the first element 3 and the second element 4 in such a manner as to match different frequencies, the antenna can be made an antenna with a higher gain over a wide band of frequencies including frequencies falling in between and frequencies adjacent to the selected frequencies.

In addition, since the antenna of the invention is regarded as the grounded antenna in a pseudo fashion by making the length of the closed loop linear portion of the second element 4 equal or be greater than one wavelength of the transmission and reception radio wave, the same effect as that provided by a configuration in which the antenna is grounded with the metallic body can be obtained in relatively high frequencies.

Furthermore, as shown in FIGS. 14, 15, the reason why the feeding point 11 and the closed loop line of the second element 4 are connected to each other via the leading line 4*a* which extends while kept close to the closed loop line is because the antenna impedance is adjusted, and the reason why the length of the leading line 4*a* is ¼ or smaller of the wavelength of the transmission and reception radio wave is because the adjustment of antenna impedance can be facilitated over a wide band and hence a good reception gain can be obtained and because in case the length of the leading line 4*a* is made longer than ¼ of the wavelength of the transmission and reception radio wave, the adjustment of antenna impedance becomes difficult to be implemented over the wide band and hence a good reception gain cannot be obtained.

Figure 16:
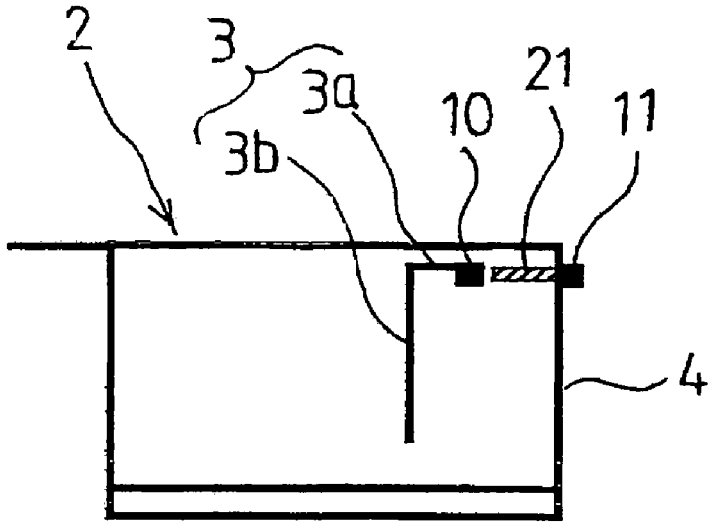
FIG. 16 is a main part detailed front view showing an antenna portion of Example 11 of the invention.

In addition, as shown in FIG. 16, in the event that the metallic fixture portion of the metallic terminal 21 is placed on the second feeding point 11, since the metallic terminal 21 is close to the first feeding point 10, the same effect can be obtained due to the metallic terminal 21 which is connected on to the second feeding point becoming close to the first feeding point 10 even in case the second feeding point 11 is not close to the feeding point 10.

Note that in the event that the first feeding point 10 and the second feeding point 11 are grounded while they are spaced apart from each other, while the metallic terminal 21 may be provided in such a manner that the same terminal is placed and fixed to the feeding point of either of the first feeding point 10 and the second feeding point 11 while becoming close to the feeding point of the other, the metallic terminal 21 may be disposed on both the feeding points in such a manner as to approach each other therefrom.

The reason why the first linear portion 3*a* of the first element 3 and the closed loop linear portion 4*b* of the second element 4 are desirably kept close to each other with the spacing ranging from 0.1 to 10 mm is because the adjustment of antenna impedance is implemented by virtue of the spacing between the linear portions of the first linear portion 3*a* of the first element 3 and the closed loop linear portion 4*b* of the second element 4 which approach each other, and hence the adjustment of antenna impedance becomes difficult to be implemented in case the first linear portion 3*a* of the first element 3 and the closed loop linear portion 4*b* of the second element 4 are provided with a spacing which exceeds 10 mm.

In addition, while a good reception gain can be obtained as long as the length of the closed loop linear portion 4*b* of the second element 4 falls within the range which is equal to or greater than one wavelength of the transmission and reception radio wave but not in excess of four wavelengths, even in case the line length thereof takes a value which deviates from an integral multiple of one-half the wavelength of the transmission and reception radio wave, in the event that the length of the closed loop linear portion 4*b* of the second element 4 is $(1+n/2)\lambda$ ($\lambda$ is the wavelength of radio wave to be transmitted and received, n is an integer of 0 to 6), since this is taken, in a pseudo fashion, as equal to where the second element is made maximum, a better reception characteristic can be obtained.

Even in the event that the first element 3 is provided at the plurality of locations within the second element 4 which is formed into the closed loop shape, the plurality of first elements 3 so provided is allowed to function independently by forming the second element 4 into the closed loop shape and making the length of the second element 4 equal or be greater than one wavelength of the transmission and reception radio wave relative to each of the first elements 3, and hence the antenna 2 is allowed to function as if a plurality of antennas 2 each made up of the first element 3 and the second element 4 were provided, and the second antenna 4 can be shared.

In addition, while the two feeding points 11, 11' are provided for the second element 4 since the two second feeding points 11, 11' of the second element 4 are desirably placed in the vicinity of the first feeding points 10, 10', respectively, they are preferably provided in such a manner that the first elements 3, 3' inflict no effect on transmission and reception, and the two first feeding points 10, 10' of the second element 4 are preferably provided in such a manner as to be spaced apart from each other by ¼ or greater of the wavelength.

The reason why the first element 103 is desirably made the line whose length is ¾ or ⁵⁄₄ of the wavelength of the transmission and reception radio wave and the second element 104 is desirably formed into the closed loop shape whose length is equal to or longer than one wavelength of the transmission and reception radio wave and is also longer than the line length of the first element 103 is because the antenna is allowed to be taken, in a pseudo fashion, as a grounded antenna so as to reduce the size thereof by making the second element 104 as long as or longer than one wavelength of the transmission and reception radio wave and longer than the line length of the first element 103 and because radio waves can be transmitted and received as efficiently as done by the grounded antenna by making the first element 103 the line whose length is ¾ or ⁵⁄₄ of the wavelength of the transmission and reception radio wave as this occurs.

Figure 29:
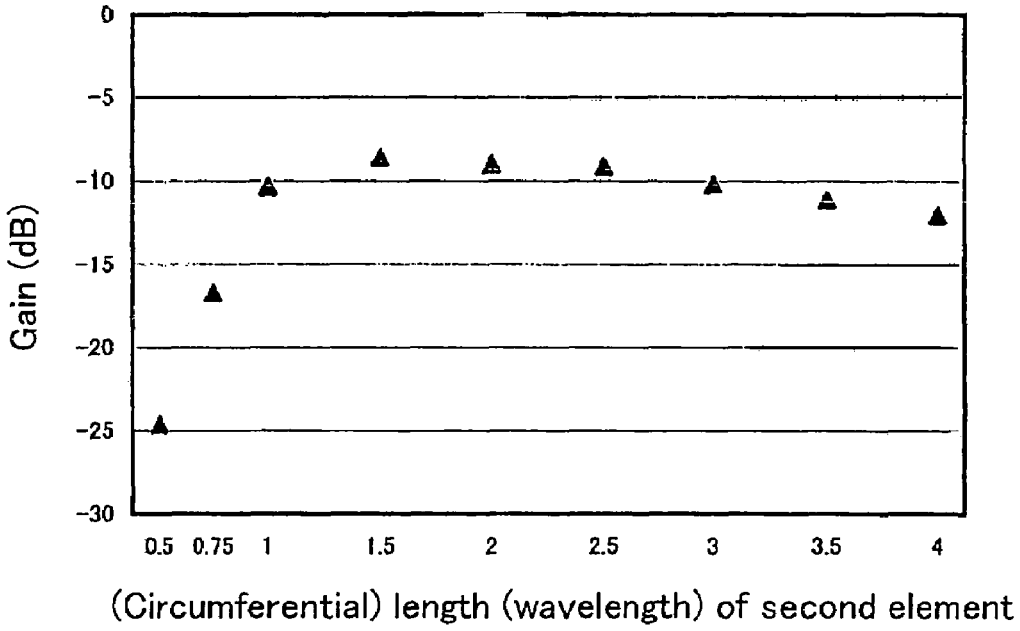
FIG. 29 is a reception characteristic chart showing change in reception gain depending on change in overall length of a second element of a glass antenna of Example 14 in the UHF band in the TV broadcast.

FIG. 29 is a reception characteristic-chart showing change in reception gain depending on change in overall length of a second element of a glass antenna of Example 14 of the invention in the UHF band in the TV broadcast.

Figure 24:
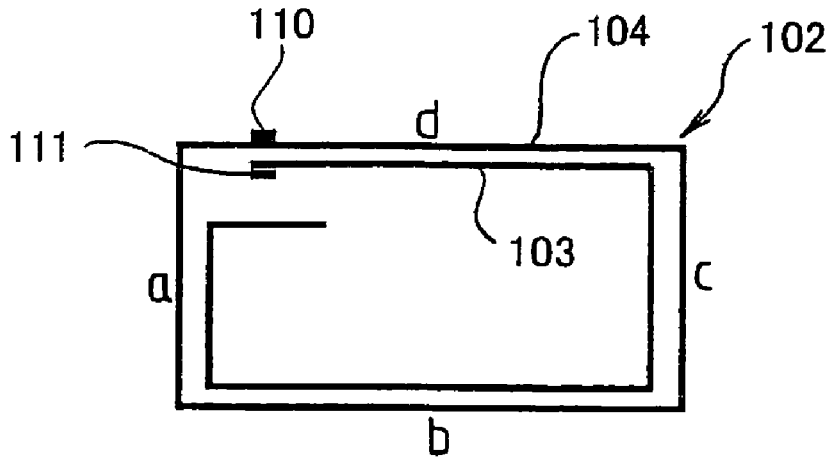
FIG. 24 is a main part detailed front view showing an antenna portion of Example 14 of the invention.

As shown in FIG. 29, in a pattern for the UHF band in the TV broadcast shown in FIG. 24, it is clear that a good reception gain can be obtained with the second element 104 having a length equal to or longer than one wavelength of the reception radio wave, when looking at the state of reception gain that changes as the line length of the second element 104 changes.

Figure 30:
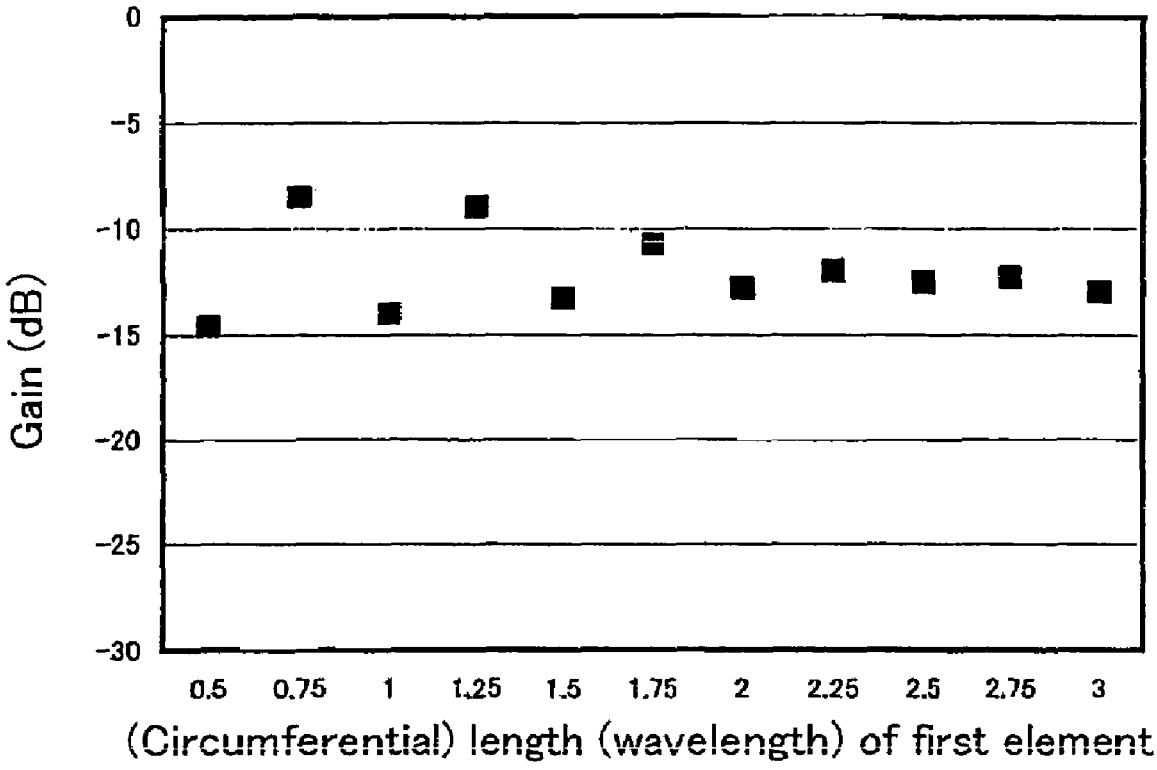
FIG. 30 is a reception characteristic chart showing change in reception gain depending on change in overall length of a first element of the glass antenna of Example 14 in the UHF band in the TV broadcast.

In addition, FIG. 30 is a reception characteristic chart showing change in reception gain depending on change in overall length of a first element of the glass antenna of Example 14 of the invention in the UHF band in the TV broadcast.

As shown in FIG. 30, in the pattern for the UHF band in the TV broadcast shown in FIG. 24, it is clear that a particularly high reception gain is obtained with the first element 103 having a length of ¾ or ⁵⁄₄ of the wavelength of the reception radio wave, when looking at the state of reception gain that changes as the line length of the first element 103 changes.

In addition, the electric field of the distal end portion of the antenna which is liable to be subjected to external effects can be stabilized by forming the second element 104 into the closed loop shape, thereby making it possible to reduce effects on the reception gain imposed by components of the movable body and human bodies.

The reason why the spacing between the first element 103 and the second element 104 at the position extended apart from the first feeding point 111 by the line length of one half the wavelength of the transmission and reception radio wave is preferably in the range of 0.5 to 10 mm, when the line length of the first element 103 is ¾ of the wavelength of the transmission and reception radio wave is as follows.

Namely, this is because the antenna element 103 mainly receives radio wave at the distal end portion which is opposite to the feeding point 111 and the adjustment of antenna impedance is implemented over a wide band by making the line of the antenna element 103 which constitutes a feeding line for the antenna element 103 and which is extended from the feeding point 111 by the length of one half the wavelength of the transmission and reception radio wave and the second element 104 which extends therealong come close to each other appropriately. Then, the reason why the aforesaid spacing is required is because the adjustment of the impedance of the antenna to the impedance (normally 50Ω and 75Ω) of a receiver can be facilitated by providing the spacing which ranges from 0.5 to 10 mm.

On the other hand, the reason why the spacing between the first element 103 and the second element 104 at the position extended apart from the first feeding point 111 by the line length equal to one wavelength of the transmission and reception radio wave is preferably in the range of 0.5 to 10 mm, when the line length of the first element 103 is ⅝ of the wavelength of the transmission and reception radio wave is as follows.

Namely, this is because the first element 103 mainly receives radio wave at the distal end portion which is opposite to the feeding point 111 and the adjustment of antenna impedance is implemented over a wide band by making the line of the first element 103 which constitutes a feeding line for the first element 103 and which is extended from the feeding point 111 by the length equal to one wavelength of the transmission and reception radio wave and the second element 104 which extends therealong come close to each other appropriately. Then, the reason why the aforesaid spacing is required is because the adjustment of the impedance of the antenna to the impedance (normally 50Ω and 75Ω) of a receiver can be facilitated by providing the spacing which ranges from 0.5 to 10 mm.

In addition, the reason why the length of the second element 104 is preferably longer than the length of the first element 103 by ¼ or greater of the wavelength of the transmission and reception radio wave is because a most efficient reception results when the length of the second element 104 deviates from that of the first element 103 by $(¼+m/2)\lambda$ (m is an integer) and the length of the first element 103 inevitably becomes short, for the element 103 resides within the element 104.

Furthermore, the reason why the upper limit of the length of the second element 104 is $(1+n/2)\lambda$ (n is an integer of 0 to 4), assuming the wavelength of transmission and reception radio wave is λ is because this can be taken, in a pseudo fashion, as equal to where the second element 104 is maximized and the reduction in reception efficiency is prevented when the element length is actually made longer than three wavelengths.

In addition, in the event that the respective line lengths of the first element 103 and the second element 104 are selected for the same frequency, a very high gain can be obtained for the selected frequency.

On the other hand, by selecting the respective line lengths of the first element 103 and the second element 104 for different frequencies of the frequency band, the antenna can be made an antenna with a high gain over a wide band including frequencies between the selected frequencies and frequencies adjacent thereto.

As to the spacing from the second element 104 to an end portion of an opening in the flange 120 of the metallic body, since the second element 104 is subjected to imposition of effect by the metallic flange 120, whereby transmission and reception of radio wave is disturbed and the impedance is changed, leading to the reduction in antenna gain, the second element 104 and the end portion of the metallic flange 120 are desirably spaced apart from each other with the spacing of 5 mm or greater.

Various Examples of the invention will be described below.

EXAMPLE 1

FIG. 1 is a view seen from the outside of a vehicle of an antenna pattern of the invention which is provided on a side window glass 1 of a vehicle.

Figure 2:
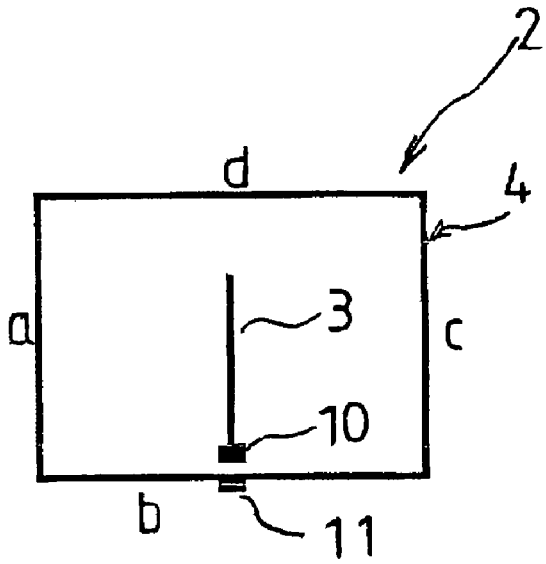
FIG. 2 is a main part detailed front view showing an antenna portion of Example 1 of the invention.

A pattern shown in FIG. 2 is such that a first element 3 and a second element 4 were printed and baked to a passenger compartment side of the glass 1 or a seal or sheet on which the pattern is printed was securely affixed to the surface of an insulating member such as a resin body and is such as to be used as an antenna for portable telephones with a frequency of 800 MHz band.

A first feeding point 10 and a second feeding point 11 were provided in such a manner that the second feeding point 11 was situated close to a lower portion of the first feeding point 10, and a perpendicular line, whose length corresponds to ¼ of the wavelength of radio wave to be transmitted and received, was extended perpendicularly upwards from the first feeding point 10, and this was made as the first element 3.

The antenna 2 is such as to be directly printed on the passenger compartment side of the window glass 1 or to be printed on a seal or sheet so as to be securely affixed thereto, and the wavelength contractibility of the glass pate 1 was assumed to be 0.6, and the length of the first element 3 was set to ¼ of the wavelength, that is, the first element 3 was made as a perpendicular line with a length of 55 mm. Note that the second feeding point 11 was provided substantially at an intermediate position along the length of a lower side b of the second element 4.

In addition, the second element 4 was provided in such a manner as to form a closed loop shape so that the first element 3 is surrounded from the second feeding point 11. While the full circumferential overall length of the second element 4 was made to correspond to two wavelengths of radio wave to be transmitted and received, in order to have a higher gain over a wide transmission and reception frequency band, the full circumferential overall length of the second element 4 was made to mach a length equal to two wavelengths of a frequency of 850 MHz.

Consequently, assuming that the wavelength contractibility of the side window glass 1 of the vehicle is 0.6 in the frequency of 850 MHz, the second element 4 was formed into a rectangular shape whose vertical sides a, c were 90 mm long, respectively, horizontal sides b, d were 120 mm long, respectively, and overall circumference was 420 mm long.

In addition, the second element 4 was positioned 15 mm apart from an inside of a metallic flange 20 of the side window glass.

Furthermore, an internal conductor line 12*a* of a coaxial cable 12 was connected to the first feeding point 10 and an external conductor line 12*b* thereof was connected to the second feeding point 11.

The antenna 2 in which the first element 3 and the second element 4 are disposed as has been described above was adjusted such that the transmission and reception gain in portable telephones with a frequency of 800 MHz band was increased.

Figure 8:
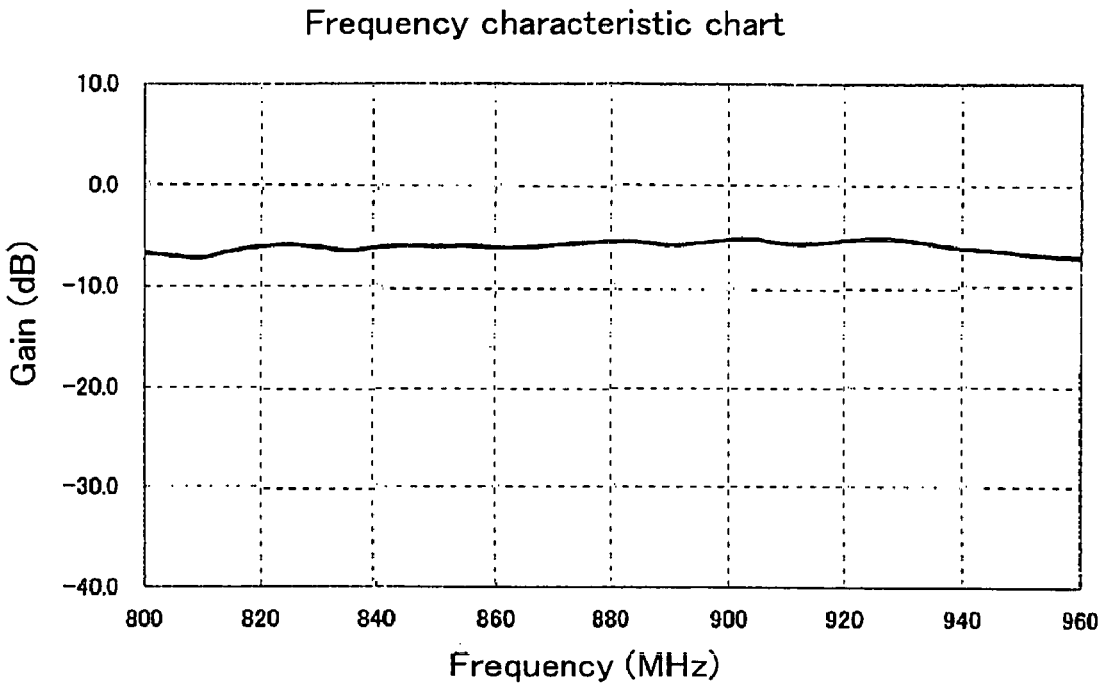
FIG. 8 is a frequency characteristic chart of an antenna gain of Example 1 in a frequency of 800 MHz.

To represent the antenna in FIG. 2 which is provided as has been described above by a gain ratio resulting when the gain of a dipole antenna is 0 db (hereinafter, referred to simply as a dipole antenna ratio), as shown in a frequency characteristic chart in FIG. 8, the transmission and reception gain became −6.1 dB on the average in the frequency of 800 MHz band, and thus a good result was able to be obtained which exceeds the average transmission and reception gain of −10.0 dB provided by conventional glass antennas which are in practical use.

In addition, according to the antenna shown in FIG. 2 which was obtained in the manner that has been described above, it is seen that there can be provided an antenna in which the antenna impedance changes little even in such a state that there are occupants in the vehicle and which is simple in configuration to thereby cause no risk that the field of vision is deteriorated and that the gain is high enough to be put to practical use.

EXAMPLE 2

Figure 3:
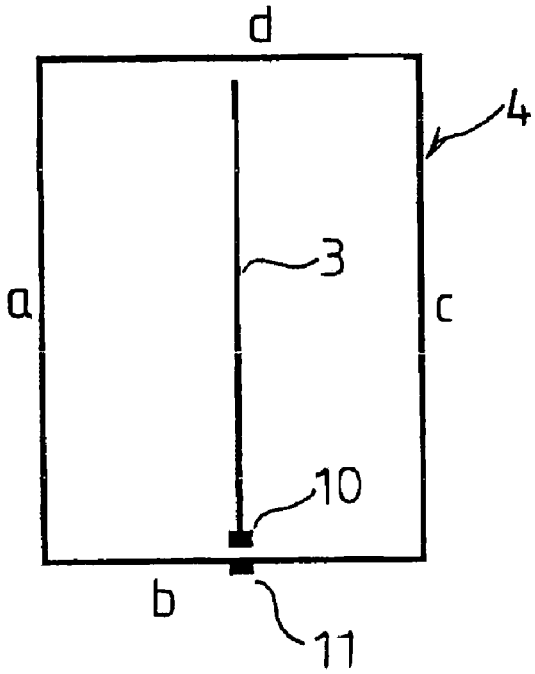
FIG. 3 is a main part detailed front view showing an antenna portion of Example 2 of the invention.

Example 2 is a modified example in which the pattern of Example 1 was modified such that the length of the first element 3 was modified to ¾ of the wavelength of radio wave to be transmitted and received, the full circumferential length of the second element 4 was to three wavelengths and the second element 4 was formed into a vertically elongated quadrangular shape as shown in FIG. 3, an antenna pattern so formed according to the invention being provided on a passenger compartment side of a sheet glass.

Namely, the length of the first element 3 was made to correspond to a line extended ¾ of the wavelength of the transmission and reception radio wave from the first feeding point 10 for the frequency of 800 MHz, that is, the length became 165 mm long, assuming that the wavelength compaction ratio of the glass plate in the frequency of 800 MHz is 0.6, and the first element 3 was provided perpendicularly so as to be a perpendicular line.

In addition, as to the second element 4, while the second element 4 was made to have a length corresponding to three times as long as the wavelength of the transmission and reception radio wave, as with Example 1, in order to increase the gain over a wind band, the length of the second element 4 was made to match a length corresponding to three wavelengths of a frequency of 850 MHz, which is different from that of the first element 3.

The full circumferential length of the second element 4 was set to a length corresponding to three wavelengths, and assuming that the wavelength compaction ratio of the glass plate in the frequency of 850 MHz is 0.6, the full circumferential length became 640 mm, the vertical sides a, c were 200 mm long, respectively, and the horizontal sides b, d were 120 mm long, respectively.

In addition, a second feeding point 11 was provided substantially at the intermediate position on the lower side b of the second element 4.

The antenna pattern of the invention was screen printed using a conductive paste on the surface of a window glass 1 and was then calcined to thereby form a window glass with the antenna. Then, after the window glass 1 so produced was mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so as to obtain a high transmission and reception gain in portable telephones with a frequency of 800 MHz band, and as a result, it has been found out that a-good transmission and reception performance which is similar to that obtained in Example 1 was obtained and hence that the antenna 2 of the invention was good enough to be put to practical use.

EXAMPLE 3

Figure 4:
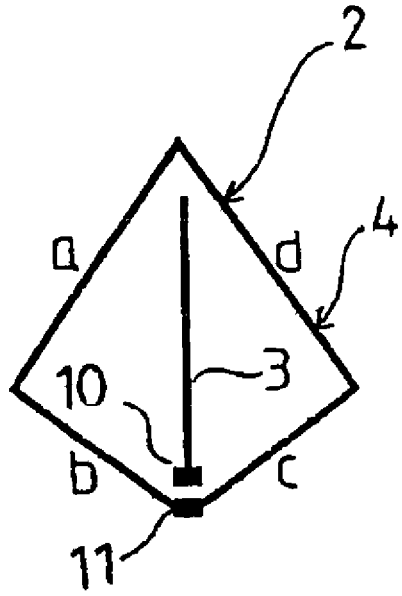
FIG. 4 is a main part detailed front view showing an antenna portion of Example 3 of the invention.

Example 3 is also a modified example in which the pattern of Example 1 was modified such that the length of the first element 3 is modified to a length corresponding to ¼ of the wavelength of the transmission and reception radio wave, the full circumferential length of the second element 4 was to a length corresponding to one wavelength, and furthermore, the shape of the second element 4 was formed into a deformed quadrangular shape as shown in FIG. 4, an antenna pattern so formed being used as an antenna for portable telephones with a frequency bandwidth of 2 GHz band. The pattern so formed was printed and baked to a passenger compartment side of a sheet glass or a seal or sheet on which the pattern was printed was securely affixed to a passenger compartment side of a window glass 1 or the surface of an insulating member such as a resin body.

The second element 4 was formed into a quadrangular shape which have four angular corners at upper and lower and left and right ends and which was symmetrical transversely.

Assuming that the wavelength compaction ratio of the glass plate in a frequency of 2100 MHz is 0.5, the length of the first element 3 became ¼ of the wavelength, that is, 18 mm, the full circumferential overall length of the second element 4 was a length equal to one wavelength, here, 1900 MHz, that is, 80 mm, upper left and right inclined sides a, d were 24 mm long, respectively, and lower left and right inclined sides b, c were 16 mm long, respectively, whereby the second element 4 was formed into a deformed quadrangular shape with a full circumferential length of 80 mm.

In addition, the second feeding point 11 was provided at the position of an intersecting point where the lower inclined sides b, c of the second element 4 intersect each other.

After a window glass 1 thus formed was mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so as to obtain a high transmission and reception gain in portable telephones with a frequency band of 2 GHz, and as a result, it has been found out that a good transmission and reception performance which is similar to that obtained in Example 1 was obtained and hence that the antenna 2 of the invention was good enough to be put to practical use.

EXAMPLE 4

Figure 5:
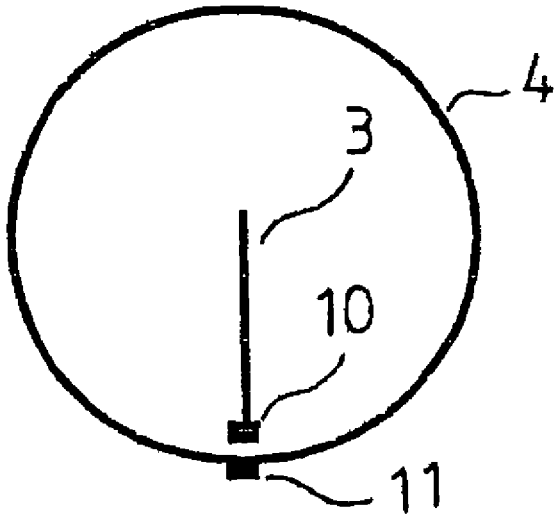
FIG. 5 is a main part detailed front view showing an antenna portion of Example 4 of the invention.

As shown in FIG. 5, Example 4 provides an antenna for use for the UHF band in the television broadcast, in which a first feeding point 10 and a second feeding point 11 were provided in such a manner that the second feeding point 11 was situated close to a lower portion of the first feeding point 10, a first element 3 was extended from the first feeding point 10 in a perpendicular direction to form a perpendicular line whose length corresponds to ¼ of the wavelength of radio wave to be transmitted and received, and a second element 4 was provided in such a manner as to surround the first element 3 from the second feeding point 11 with a full circumferential length corresponding to one and a half the wavelength.

The pattern so formed was directly printed and baked to a passenger compartment side of a sheet glass or a seal or sheet on which the pattern was printed was securely affixed to a passenger compartment side of a window glass or the surface of an insulating member such as a resin body.

Assuming that the wavelength compaction ratio of the glass plate in a frequency of 600 MHz is 0.6, the length of the first element 3 became ¼ of the wavelength of the transmission and reception radio wave, that is, 75 mm, and the full circumferential overall length of the second element 4 was a length equal to one and a half the wavelength, here, 500 MHz, that is, the second element 4 was formed into a circular shape with a full circumferential overall length of 540 mm.

After a window glass 1 thus formed had been mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so that the reception gain for frequencies of 470 to 770 MHz in the UHF band in the TV broadcast was increased.

Figure 9:
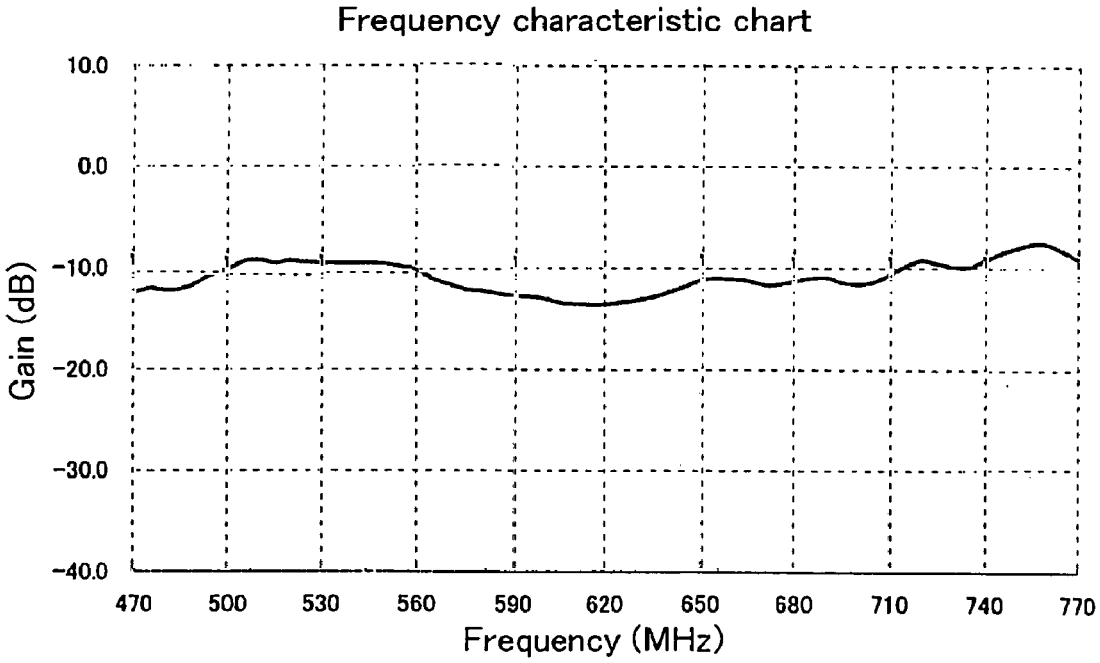
FIG. 9 is a frequency characteristic chart of an antenna gain of Example 4 in the UHF band in the TV broadcast.

To represent the antenna in FIG. 5 which is provided as has been described above by the dipole antenna ratio, as shown in a frequency characteristic chart in FIG. 9, the reception gain became −10.9 dB on the average in the UHF band, thus a good result being able to be obtained which exceeds largely the average reception gain of −20.0 dB provided by conventional glass antennas which are in practical use.

Figure 10:
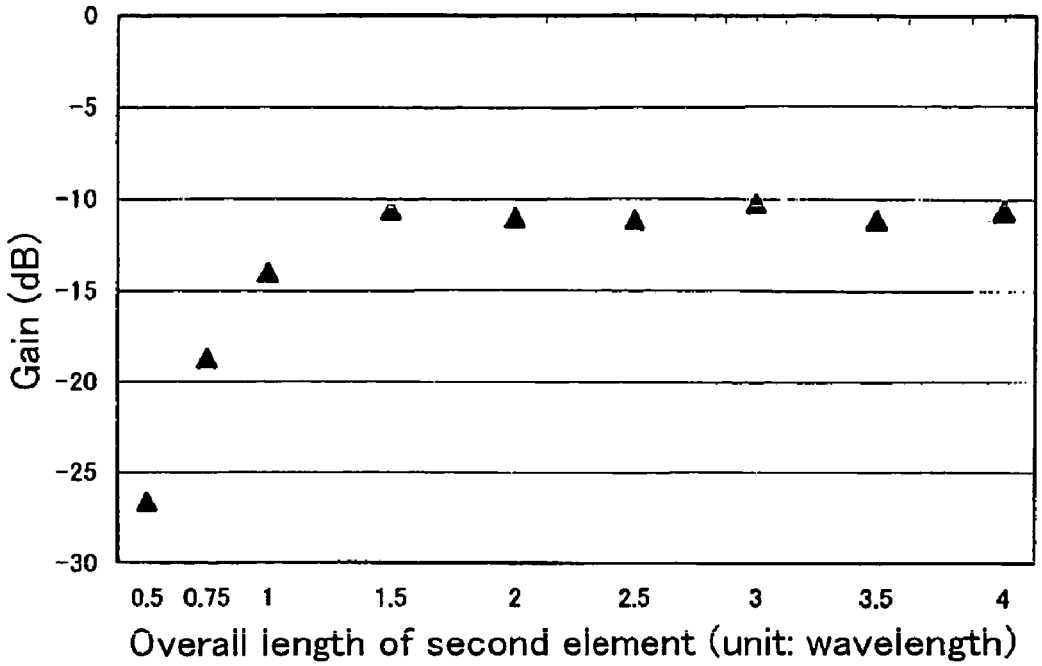
FIG. 10 is a reception characteristic chart showing change in reception gain depending on change in overall length of a second element 4 of a glass antenna of Example 4 in the UHF band in the TV broadcast.

FIG. 10 shows a change in reception gain when the overall length of the second element 4 is changed, and according to the figure, it is seen that a good reception characteristic can be obtained when the overall length of the second element 4 is equal to or greater than one wavelength.

Figure 11:
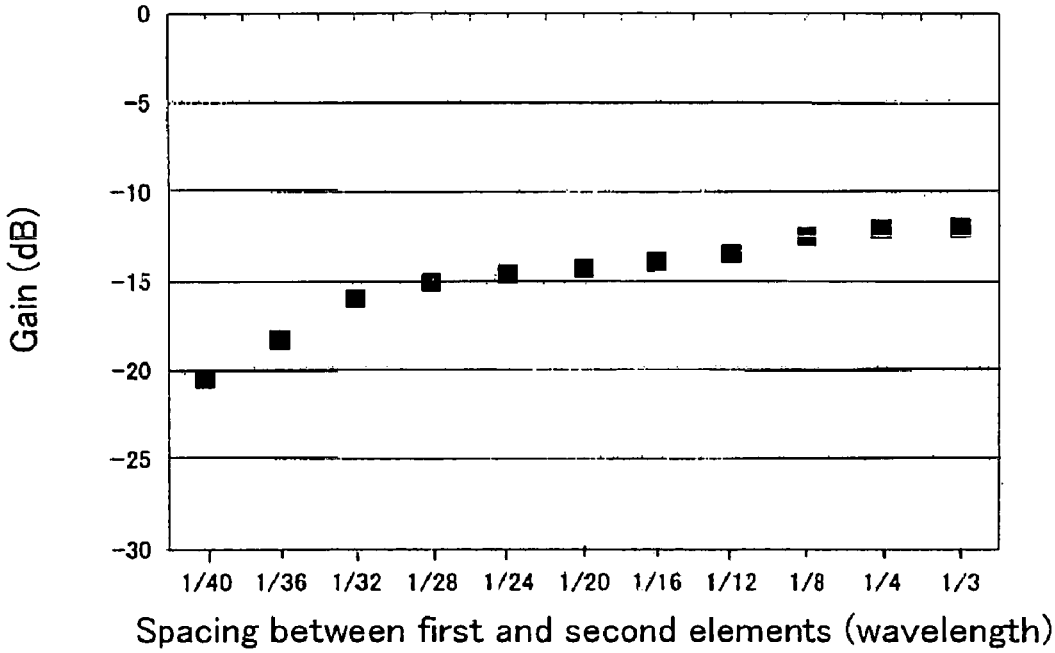
FIG. 11 is a reception characteristic chart showing change in reception gain depending on change in spacing between a first element and the second element of the glass antenna of Example 4 in the UHF band in the TV broadcast.

FIG. 11 shows a change in gain which changes depending on the spacing between the first element 3 and the second element 4, and it is seen that a good reception characteristic can be obtained when the first element 3 and the second element 4 were provided spaced apart from each other with a spacing of 1/32 or greater of the wavelength.

EXAMPLE 5

Figure 6:
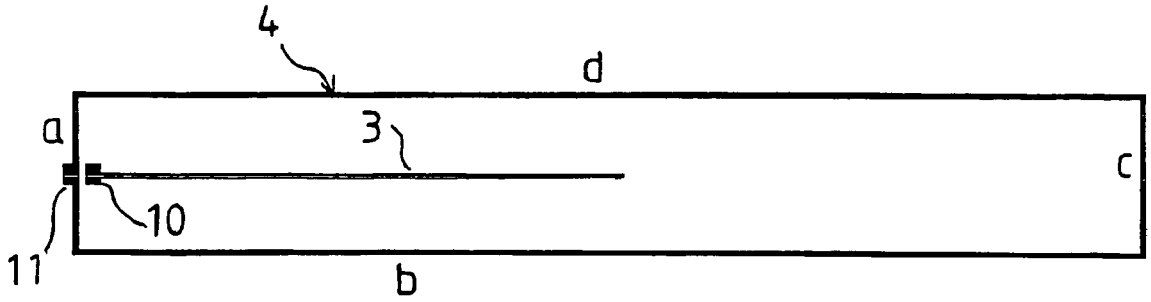
FIG. 6 is a main part detailed front view showing an antenna portion of Example 5 of the invention.

As shown in FIG. 6, Example 5 provides an antenna for use for the VHF-high band in the television broadcast, in which a first feeding point 10 and a second feeding point 11 were provided in such a manner that the second feeding point 11 was situated close to a left-hand side portion of the first feeding point 10, a first element 3 was extended horizontally rightwards from the first feeding point 10 in a transverse direction to form a horizontal line whose length corresponds to ¼ of the wavelength of radio wave to be transmitted and received, and a second element 4 was provided in such a manner as to surround the first element 3 from the second feeding point 11 to thereby formed into a rectangular shape with a full circumferential length corresponding to one wavelength.

Assuming that the wavelength compaction ratio of the glass plate in a frequency of 210 MHz is 0.7, the length of the first element 3 became ¼ of the wavelength of the transmission and reception radio wave, that is, 250 mm, and this first element 3 was provided in the horizontal direction to thereby form a horizontal line.

As to the second element 4, the full circumferential overall length thereof was the length equal to one wavelength of the transmission and reception radio wave, and assuming that the wavelength compaction ratio of the glass plate in a frequency of 200 MHz is 0.7, the second element 4 was formed into a rectangular shape in which the full circumferential length became 1040 mm, vertical sides a, c were 100 mm long, respectively, and horizontal sides b, d were 420 mm, respectively.

In addition, a second feeding point 11 was provided substantially at an intermediate position along the length of a vertical side a of the second element 4.

The antenna pattern of the invention was screen printed using a conductive paste on the surface of a window glass 1 and was then calcined to thereby form a window glass with the antenna. Then, after the window glass 1 so produced had been mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so as to obtain a high transmission and reception gain as an antenna for frequencies of 170 to 222 MHz in the VHF-high band in the TV broadcast, and as a result, it has been found out that a good transmission and reception performance which is similar to that obtained in Example 1 was obtained and hence that the antenna 2 of the invention was good enough to be put to practical use.

EXAMPLE 6

Figure 7:
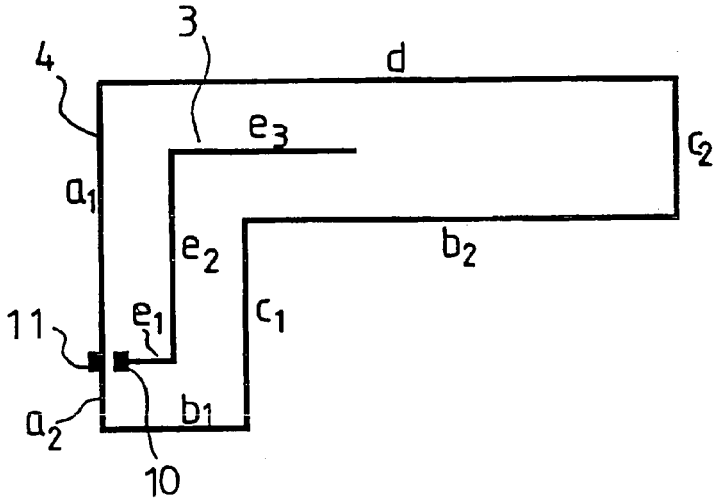
FIG. 7 is a main part detailed front view showing an antenna portion of Example 6 of the invention.

As shown in FIG. 7, Example 6 provides an antenna for use for a band in the FM radio broadcast and the VHF-Low band in the television broadcast, in which a first feeding point 10 and a second feeding point 11 were provided in such a manner that the second feeding point 11 was situated close to a left-hand side portion of the first feeding point 10, and a first element 3 was provided which was formed into a crank-like shape by extending a horizontal line $e_1$ rightwards from the first feeding point 10, providing a vertical line $e_2$ from a distal end of the horizontal line e1 and furthermore, providing a horizontal line $e_3$ from a distal end of the vertical line $e_2$, the length of the first element 3 being a length corresponding to ¼ of the wavelength of radio wave to be transmitted and received.

In addition, a second element 4 was provided in such a manner as to surround the crank-shaped line of the first element 3 from the second feeding point 11 to thereby formed into an L-like shape with a full circumferential length corresponding to one wavelength.

The antenna of the invention is such as to be used as an antenna whose frequency band corresponds to the band in the FM radio broadcast and the VHF-Low band in the television broadcast, and the pattern formed as has been described above was printed and baked to a passenger compartment side of a sheet glass or a seal or sheet on which the pattern was printed was securely affixed to a passenger compartment side of a window glass or the surface of an insulating member such as a resin body.

The respective dimensions are as follows which are determined in consideration of the wavelength compaction ratio of the glass plate:

First Element 3 Overall Length=525 mm;
Horizontal Line $e_1$=65 mm; Vertical Line $e_2$=250 mm;
Horizontal Line $e_3$=210 mm;
Second element 4 overall Length=2,100 mm;
Vertical Line $a_1$=325 mm; Vertical Line $a_2$=75 mm;
Horizontal Line $b_1$=150 mm; Horizontal Line $b_2$=500 mm;
Vertical Line $c_1$=250 mm; Vertical Line $c_2$=150 mm;
Horizontal Line d=650 mm.

In addition, the second feeding point 11 was provided at a position 75 mm apart from a lower end of a left vertical side a of the second element 4, and the first feeding point 10 was provided at a position which is close to a right side of the second feeding point 11. The vertical line $e_2$ is such as to be provided between the vertical line $a_1$ and the vertical line $c_1$ with a spacing of 75 mm in parallel therewith, and the horizontal line $e_3$ was provided between the horizontal line $b_2$ and the horizontal line d with a spacing of 75 mm in parallel therewith.

The antenna pattern of the invention was screen printed using a conductive paste on the surface of a window glass 1 and was then calcined to thereby form a window glass with the antenna Then, after the window glass 1 so produced had been mounted in a side window of a vehicle, an internal conductor line 12*a* of a coaxial cable 12 was connected to the first feeding point 10 and an external conductor line 12*b* was connected to the second feeding point 11.

The antenna 2 of Example 6 was tuned so as to obtain a high transmission and reception gain as an antenna for the band in the FM radio broadcast and the VHF-Low band in the television broadcast, and as a result, it has been found out that a good transmission and reception performance which is similar to those obtained by the other Examples was obtained and hence that the antenna 2 of the invention was good enough to be put to practical use.

EXAMPLE 7

Example 7 is a modified example in which the pattern of Example 1 is modified.

Figure 12:
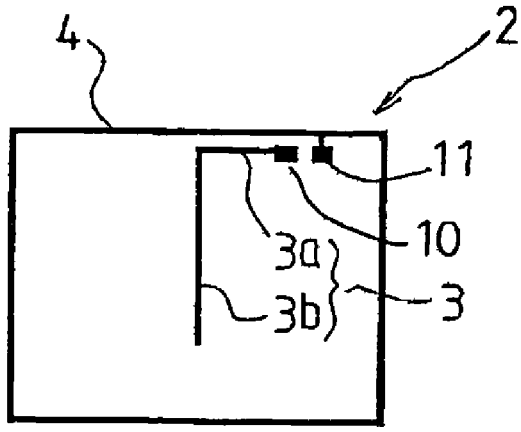
FIG. 12 is a main part detailed front view showing an antenna portion of Example 7 of the invention.

Main points in which Example 7 differs from Example 1 shown in FIG. 2 are that the shape of the first element 3 was modified to an L-like shape as shown in FIG. 12, that the linear portion (a first linear portion 3*a*) which corresponds to the length of ⅛ or smaller of the wavelength of the transmission and reception radio wave from a side of the first element 3 which faces the first feeding point 10 was modified to have a capacity combination with the second element 4, and furthermore that the full circumferential length of the second element 4 was modified to a length which corresponds one and a half the wavelength of the transmission and reception radio wave.

In the first element 3, the first linear portion 3*a* which was extended horizontally from the first feeding point 10 was made to become close to a horizontal line of the rectangular closed loop line which is at an upper side of the second element 4 for a capacity coupling, and a second linear portion 3*b* was extended downwards from a distal end of the first linear portion 3*a*, so that the second linear portion 3*b* extends away from the upper side of the second element 4.

In addition, the length of the first element 3 was ¼ of the wavelength of the transmission and reception radio wave, and the length of the first linear portion 3*a* was equal to or shorter than ⅛ of the wavelength of the transmission and reception radio wave. Furthermore, the full circumferential length of the second element 4, which was provided in such a manner as to surround the first element 3, was one and a half the wavelength, and an antenna pattern so formed was then provided on a passenger compartment side of a sheet glass.

Namely, for the band for portable telephones of 800 MHz, the length of the first element 3 became a length equal to ¼ of the wavelength of the transmission and reception radio wave from the first feeding point 10, assuming that the wavelength compaction ratio of the glass plate in the frequency of 800 MHz is 0.6, that is 55 mm, the length of the first linear portion 3*a* was 15 mm and the length of the second linear portion 3*b*, which was extended perpendicularly from the distal end of the first linear portion 3*a*, was 40 mm.

In addition, as to the second element 4, while the length thereof was a length corresponding to one and a half the wavelength of the transmission and reception radio wave, in order to have a high gain over a wide band as with Example 1, the length of the second element 4 was set to a length that corresponds to one and a half the wavelength of a frequency of 850 MHz, which is different from that of the first element 3, and assuming that the wavelength compaction ratio of the glass plate in the frequency of 850 MHz is 0.6, the full circumferential length thereof became 320 mm, vertical sides a, c were 60 mm long, and horizontal sides b, d were 100 mm long, whereby a configuration could be provided in which the antenna area was reduced compared with that of Example 1.

A second feeding point 11 was provided above the upper side of the second element 4 and a first feeding point 10 was provided at a position which was near a lower portion of the second feeding point 11.

The antenna pattern of the invention was screen printed using a conductive paste on the surface of a window glass 1 and was then calcined to thereby form a window glass with the antenna. Then, after the window glass 1 so produced had been mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so as to increase the transmission and reception gain in portable telephones with 800 MHz band, and as a result, it has been found out that a good transmission and reception performance which is similar to that obtained by Example 1 was obtained and hence that the antenna 2 of the invention was good enough to be put to practical use.

EXAMPLE 8

Figure 13:
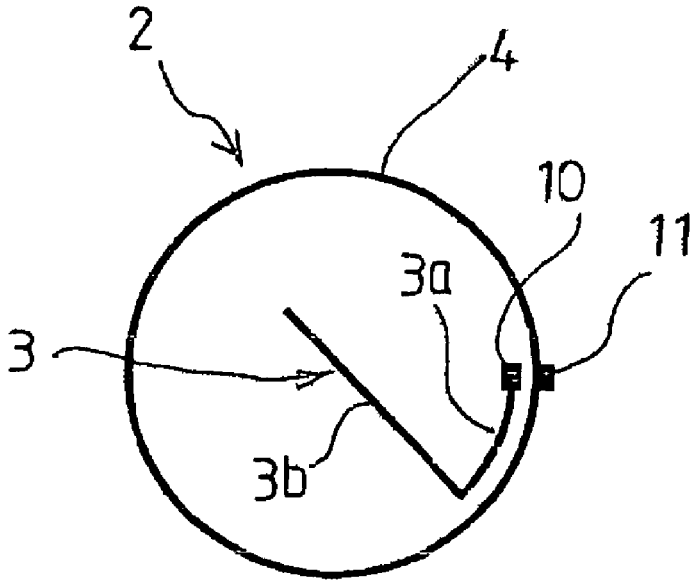
FIG. 13 is a main part detailed front view showing an antenna portion of Example 8 of the invention.

As shown in FIG. 13, while Example 8 is a modified example in which the pattern of Example 4 is modified, the resulting pattern was suitable for receiving radio waves in the VHF-HIGH band in the TV broadcast. Main points in which Example 8 differs from Example 4 are that the shape of the first element 3 shown in FIG. 5 was modified to an L-like shape or a V-like shape and that a linear portion (a first linear portion 3*a*) corresponding to a length of ⅛ or smaller wavelength of the reception radio wave from a side of the first element 3 which faces a feeding pint 10 was made to have a capacity combination with an inside of the circular second element 4.

Namely, the first element 3 included, in the inside of the second element 4 which was formed into the closed loop line, the arc-shaped first linear portion 3*a* provided to extend from the first feeding point 10 provided in the vicinity of the second feeding point 11 for a capacity coupling with the second element, and a second linear portion 3*b* was extended from a distal end of the first linear portion 3*a* towards the center of the circular second element 4, so that the second linear portion 3*b* extended away from the second element 4.

Namely, assuming that the wavelength compaction ratio of the glass plate in a frequency of 210 MHz is 0.7, the length of the first element 3 in Example 8 was ¼ of the reception radio wave, that is, a length of 250 mm, the length of the first linear portion 3*a* was a length equal to or smaller than ⅛ of the wavelength of the transmission and reception radio wave, which was 90 mm, and the length of the second linear portion 3*b*, which was extended from the first linear portion 3*a* towards the center of the second element 4, was 160 mm.

In addition, as to the second element 4, the full circumferential overall length thereof was set to a length equal to one wavelength of the reception radio wave, and assuming that the wavelength compaction ratio of the glass plate in a frequency of 200 MHz is 0.7, the second element 4 was formed into a circle with a full circumferential length of 1040 mm and a diameter of about 330 mm.

The antenna pattern of the invention was screen printed using a conductive paste on the surface of a window glass 1 and was then calcined to thereby form a window glass with the antenna. Then, after the window glass 1 so produced has been mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so as to increase the transmission and reception gain of an antenna used as one for the VHF-high band in the TV broadcast, and as a result, it has been found out that a good transmission and reception performance which is similar to that obtained by Example 5 was obtained and hence that the antenna 2 of the invention was good enough to be put to practical use.

EXAMPLE 9

As shown in FIG. 14, Example 9 is a modified example in which the pattern of Example 3 was modified such that a leading wire 4*a* for a second feeding point 11 of a second element 4 which was formed into a substantially rectangular closed loop line was provided to extend along the closed loop line in such a manner as to be kept close thereto inside the closed loop line with a length of ¼ or smaller of the wavelength of radio wave to be transmitted and received, and the feeding point 11 was provided at the position of an intersecting point where lower inclined sides b, c of the second element 4 intersect each other, which position was in the vicinity of a feeding point 10.

The length of the first element 3 was modified to a length corresponding to ¼ of the wavelength of the transmission and reception radio wave, the length of the closed loop portion around the full circumference of the second element 4 was to a length corresponding to double the wavelength, and furthermore, the length of the leading line 4*a* which connects the closed loop line to the second feeding point 11 was a length of ¼ or smaller of the wavelength of the transmission and reception radio wave, so that the resulting pattern was used for an antenna for portable telephones with a frequency bandwidth of 2 GHz. The pattern so formed was printed and baked to a passenger compartment side of a sheet glass or a seal or sheet on which the pattern was printed was securely affixed to a passenger compartment side of a window glass 1 or the surface of an insulating member such as a resin body.

Assuming that the wavelength compaction ratio of the glass plate in a frequency of 2100 MHz is 0.5, the length of the first element 3 was ¼ of the wavelength of the transmission and reception radio wave, that is, 18 mm, the full circumferential overall length of the second element 4 was a length equal to double the wavelength, here, 1900 MHz, that is, 160 mm, upper left and right inclined sides a, d were 48 mm long, respectively, and lower left and right inclined sides b, c were 32 mm long, respectively, whereby the second element 4 was formed into a deformed quadrangular shape with a full circumferential length of 160 mm.

After a window glass 1 thus formed had been mounted in a side window of a vehicle, an internal conductor line 12*a* of a coaxial cable 12 was connected to the first feeding point 10 and an external conductor line 12*b* was connected to the second feeding point 11.

The antenna 2 in which the first element 3 and the second element 4 are disposed as has been described above was tuned so as to obtain a high transmission and reception gain in portable telephones with a frequency band of 2 GHz, and as a result, it has been found out that a good transmission and reception performance which is similar to that obtained in Example 3 was obtained and hence that the antenna 2 of the invention was good enough to be put to practical use.

EXAMPLE 10

Example 10 provides a modified example in which the pattern of Example 7 was modified such that as shown in FIG. 15, a leading line 4*a* for a second feeding point 11 of a second element 4 was provided to extend along a closed loop line in such a manner as to be kept close thereto inside the closed loop line with a length of ¼ or smaller of the wavelength of radio wave to be transmitted and received.

The length of a first element 3 was modified to a length corresponding to ¼ of the wavelength of the transmission and reception radio wave, the length of a closed loop portion around the full circumference of the second element 4 was to a length corresponding to one wavelength, and furthermore, the length of the leading line 4*a* which connects the closed loop line to the second feeding point 11 was a length of ¼ or smaller of the wavelength of the transmission and reception radio wave, whereby the pattern so formed was printed and backed to a passenger compartment side of a sheet glass or a seal or sheet on which the pattern was printed was securely affixed to a passenger compartment side of a window glass 1 or the surface of an insulating member such as a resin body as an antenna for frequencies of 470 to 770 MHz in the UHF band in the TV broadcast.

Assuming that the wavelength compaction ratio of the glass plate in a frequency of 600 MHz is 0.6, the length of the first element 3 was ¼ of the wavelength of the transmission and reception radio wave, that is, 75 mm, the full circumferential overall length of the second element 4 was a length equal to the wavelength, that is, 360 mm, assuming that the frequency is 500 MHz. After the window glass 1 so produced had been mounted in a side window of a vehicle, an internal conductor line 12*a* of a coaxial cable 12 was connected to the first feeding point and an external conductor line 12*b* was connected to the second feeding point 11.

The antenna 2 in which the first element 3 and the second element 4 are disposed as has been described above was tuned to increase the reception gain for frequencies of 470 to 770 MHz in the UHF band in the TV broadcast.

Figure 17:
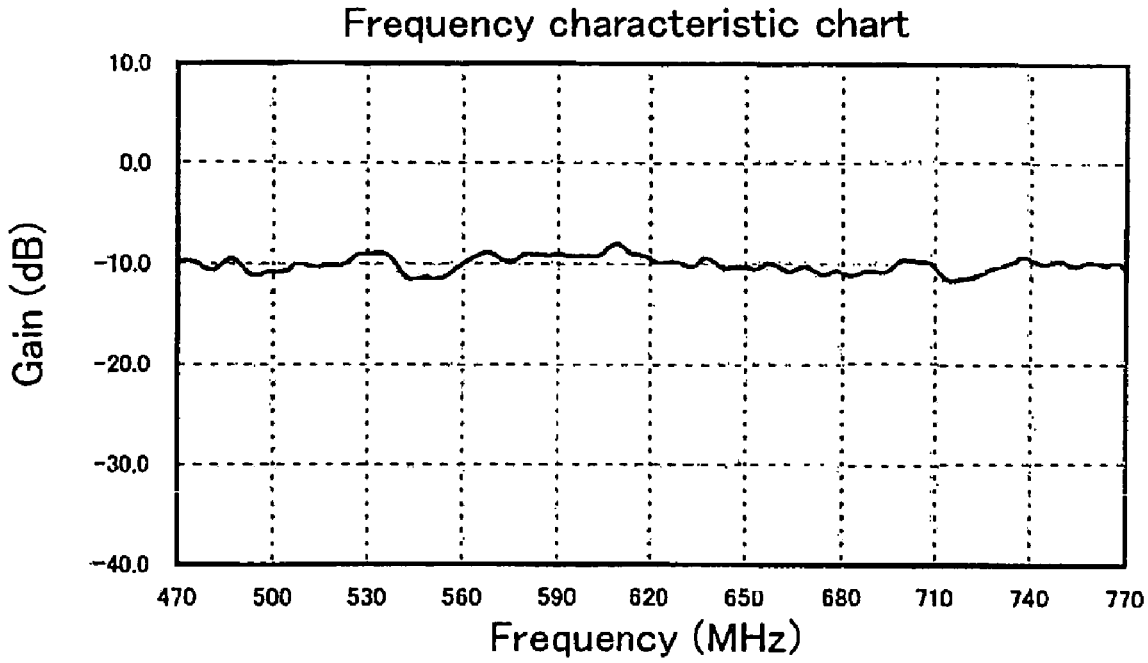
FIG. 17 is a frequency characteristic chart of an antenna gain of Example 10 in the UHF band in the TV broadcast.

To represent the antenna in FIG. 15 which is provided as has been described above by the dipole antenna ratio, as shown in a frequency characteristic chart in FIG. 17, the reception gain became −10.3 dB on the average in the UHF band, thus a good result being able to be obtained which largely exceeds the average reception gain of −20.0 dB provided by conventional glass antennas which are in practical use.

Figure 18:
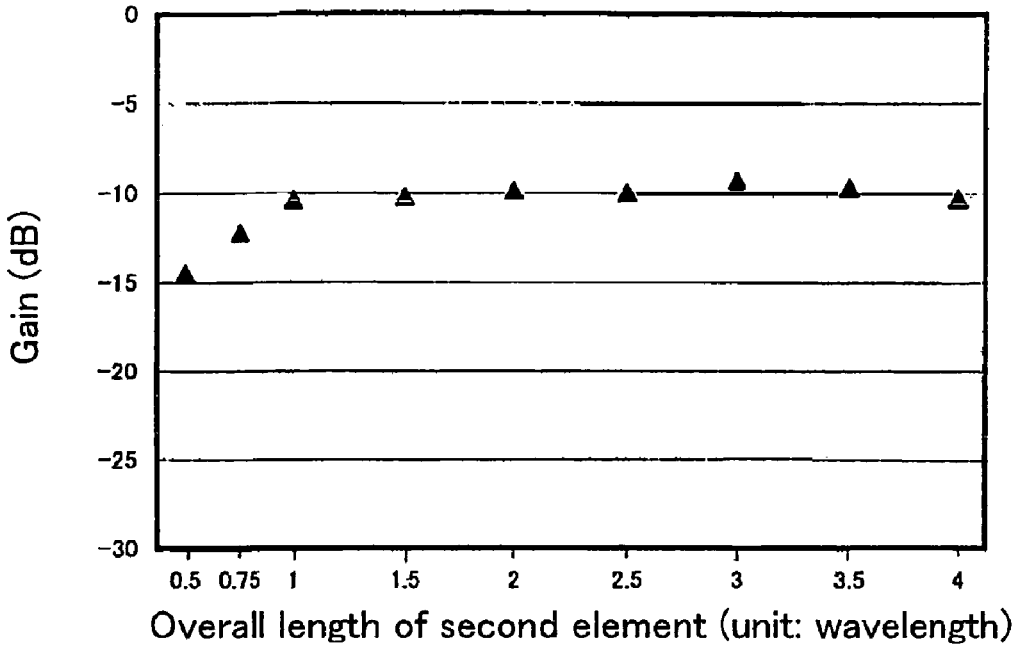
FIG. 18 is a reception characteristic chart showing change in reception gain depending on change in overall length of a second element 4 of a glass antenna of Example 10 in the UHF band in the TV broadcast.

FIG. 18 shows a change in reception gain which changes as the overall length of the second element 4 changes, and according to the figure, it is seen that a good reception characteristic was obtained when the overall length of the second element 4 was equal to or greater than one wavelength.

Figure 19:
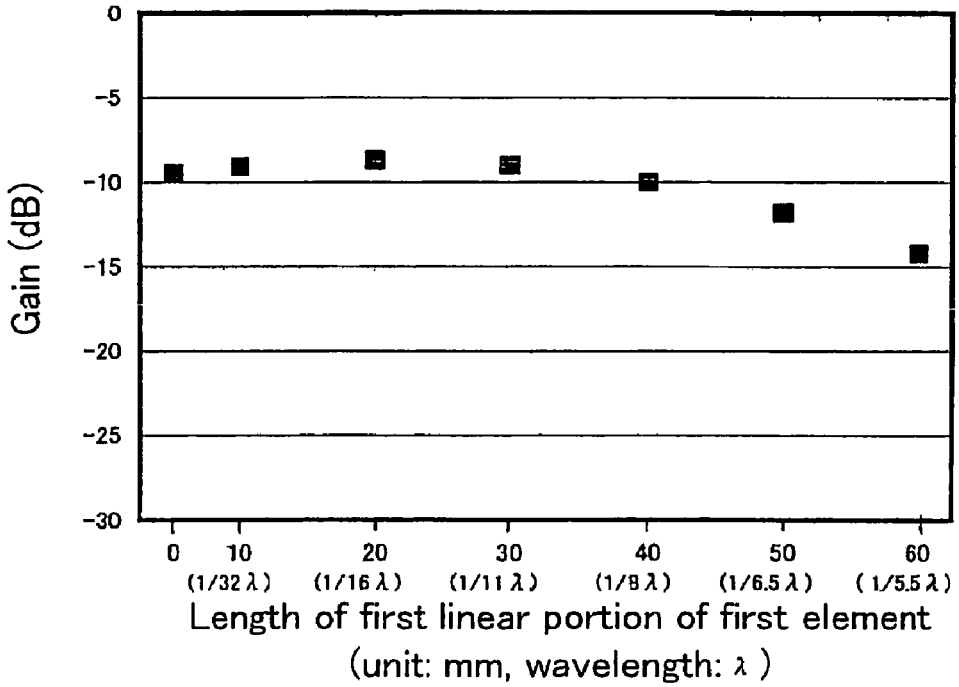
FIG. 19 is a reception characteristic chart showing change in reception gain depending on change in length of a first linear portion of a first element of the glass antenna of Example 10 in the UHF band in the TV broadcast.

FIG. 19 shows a change in reception gain which changes as the length of the linear portion (the first linear portion 3*a*) of the first element 3 which is close to the second element 4 changes, and it is seen that a good reception characteristic could be obtained when the length of the first linear portion 3*a* was equal to or smaller than ⅛ of the wavelength of the transmission and reception radio wave.

EXAMPLE 11

As shown in FIG. 16, Example 11 is a modified example in which the pattern of Example 7 was modified.

Points in which Example 11 differs from Example 7 are that while a first feeding point 10 and a second feeding point 11 were not close to each other, instead of this, as shown in FIG. 16, a terminal metallic fixture portion of a metallic terminal 21 which was placed on and fixed to the second feeding point 11 was provided in such a manner as to be close to the first feeding point 10, so that the two feeding points were made to become close to each other substantially, that a horizontal auxiliary line was provided to extend from an upper left-hand side corner portion of a second element 4, and that two lines were provided as a bottom side line of the second element 4, and the other features remained substantially the same as those of Example 7.

Namely, a first element 3 was modified to a length which corresponds to ¼ of the wavelength of a radio wave to be received, the full circumferential length of the second element 4 was to a length which corresponds to a length equal to one wavelength, and furthermore a pattern resulting from the modification was used as an antenna for frequencies of 470 to 770 MHz in the UHF band in the TV broadcast. The pattern so produced was then printed and baked to a passenger compartment side of a sheet glass or a seal or sheet on which the pattern was printed was securely affixed to a passenger compartment side of a window glass 1 or the surface of an insulating member such as a resin body.

After the window glass 1 thus produced had been mounted in a side window of a vehicle, an internal conductor line 12*a* of a coaxial cable 12 was connected to the first feeding point 10 and an external conductor line 12*b* was connected to the second feeding point 11.

The antenna 2 which is disposed as has been described above was tuned so as to obtain a high reception gain in frequencies of 470 to 770 MHz in the UHF band in the TV broadcast, and as a result, it has been found out that a good reception performance which is similar to that obtained by Example 7 was obtained and hence that the antenna 2 of the invention was good enough to be put to practical use.

EXAMPLE 12

Figure 20:
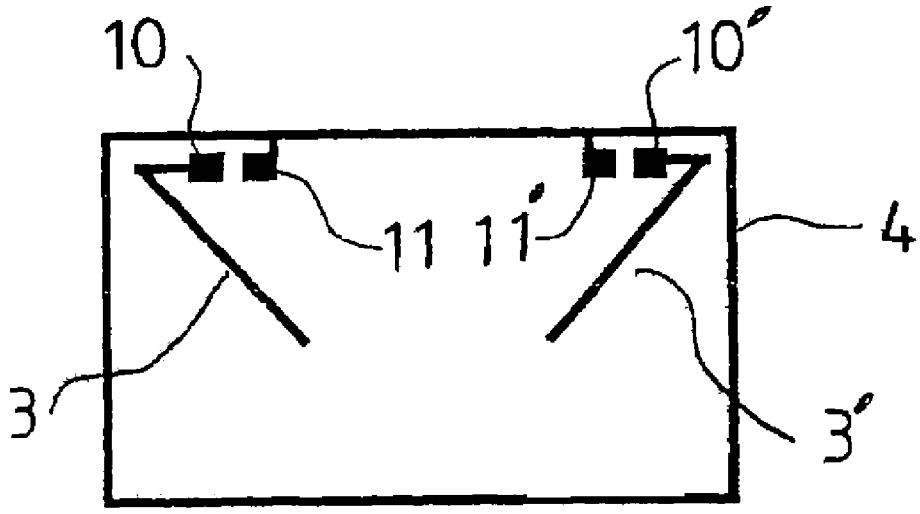
FIG. 20 is a main part detailed front view showing an antenna portion of Example 12 of the invention.

As shown in FIG. 20, in Example 12, a feeding point was provided in the vicinity of each of upper left-hand side and right-hand side inner corners of a second element 4 which was a substantially quadrangular closed loop line, and first elements 3, 3' were provided from the two left and right first feeding points 10, 10', respectively, and patterns of the two first elements 3, 3' were made transversely symmetrical with each other.

In addition, two second feeding points 11, 11' were provided for the closed line of the second element 4, and the two feeding points 11, 11' were provided on the closed loop line which was the second element 4 or connected thereto via leading lines while being situated at positions which were in the vicinity of the first feeding points 10, 10', respectively.

In this Example, the first element 3, which is one of the first elements 3, 3', and the closed loop second element 4 as seen from the second feeding point 11 are used as an antenna for frequencies of 470 to 770 MHz in the UHF band in the TV broadcast, whereas the other first element 3' and the closed loop second element 4 as seen from the second feeding point 11' were used similarly as an antenna for frequencies of 470 to 770 MHz in the UHF band in the TV broadcast, whereby the antenna 2 was made as a two-system antenna.

The lengths of the respective first elements 3, 3' were a length which corresponds to ¼ of the wavelength of a radio wave to be transmitted and received, and the length of a closed loop portion of the second element 4 was a length which corresponds to one and a half the wavelength.

After the pattern was printed on a passenger compartment side of a sheet glass and was then baked thereto to thereby form the pattern on the sheet glass or a seal or sheet on which the pattern was printed was securely affixed to a passenger compartment side of the window glass 1 or the surface of an insulating member such as a resin body.

Assuming that the wavelength compaction ratio of the glass plate in a frequency of 600 MHz is 0.6, the lengths of the two first elements 3, 3' each became ¼ of the wavelength of the transmission and reception radio wave, that is, 75 mm, and the full circumferential overall length of the second element 4 became one and a half the wavelength, that is, 540 mm, assuming that the frequency is 500 MHz.

After the window glass 1 thus produced was mounted in a side window of a vehicle, an internal conductor line 12*a* and an external conductor line 12*b* of a coaxial cable 12 were connected, respectively, to the first feeding point 10, which is one of the first feeding points, and the second feeding point 11, which was one of the second feeding points, and furthermore, an internal conductor line 12*a* and an external conductor line 12*b* of the coaxial line 12 were connected to the other first feeding point 10' and the other second feeding point 11'.

The antenna 2 in which the first elements 3, 3' and the second element 4 are disposed as has been described above is tuned to increase the reception gain in frequencies of 470 to 770 MHz in the UHF band in the TV broadcast.

Figure 22:
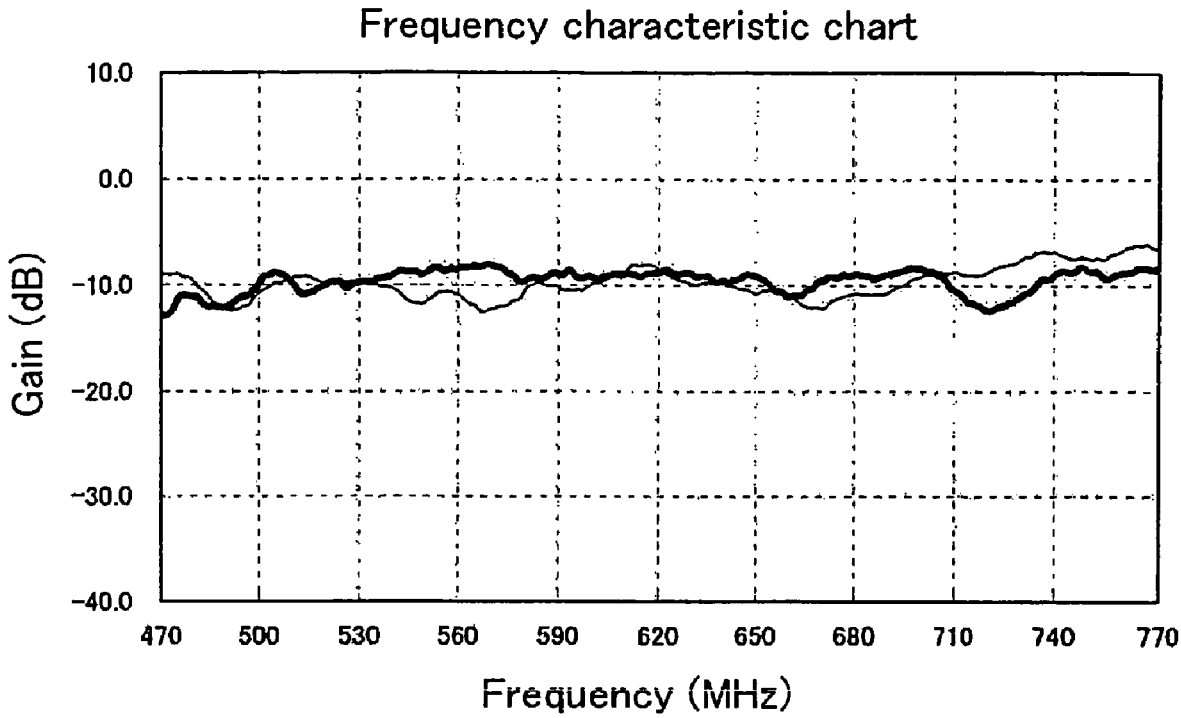
FIG. 22 is a frequency characteristic chart of an antenna gain of Example 12 in the UHF band in the TV broadcast.

To represent the two antennas in FIG. 20 which were provided as has been described above by the dipole antenna ratio, as shown by a thick solid line and a thin solid line in a frequency characteristic chart in FIG. 22, the reception gains became −9.6 dB and −9.8 dB, respectively, on the average in the UHF band, and thus a good result is able to be obtained which highly exceeds the average reception gain of −20.0 dB provided by conventional glass antennas which are in practical use, and furthermore, a superior reception performance could be obtained by using these two antennas for diversity reception.

Thus, by providing the plurality of first elements 3, 3' within the closed loop second element 4, the exclusive area where the second element 4 was provided can be halved compared with a case where two closed loop antennas were provided in separate areas.

EXAMPLE 13

Figure 21:
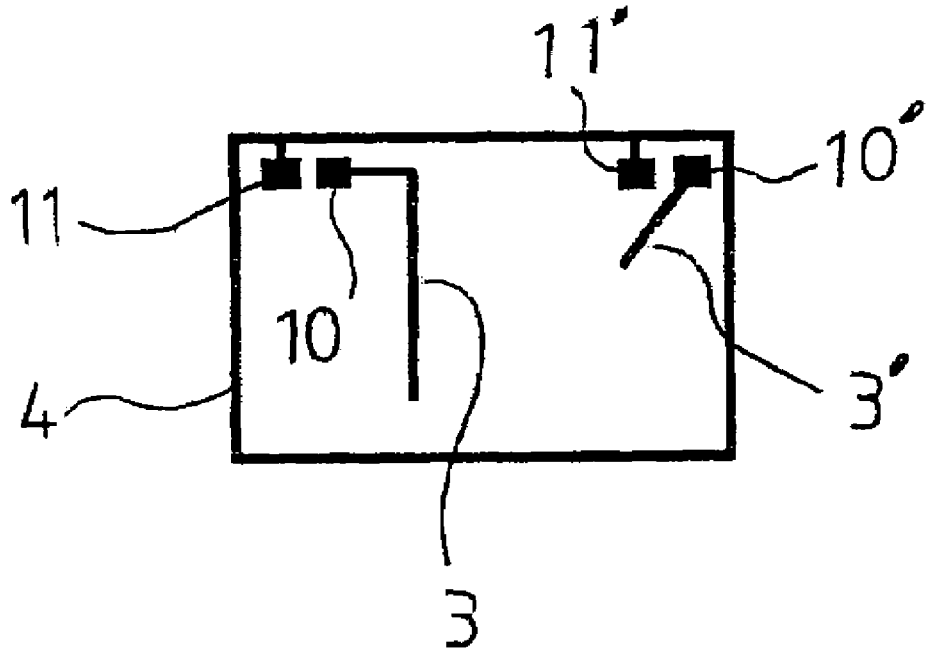
FIG. 21 is a main part detailed front view showing an antenna portion of Example 13 of the invention.

Example 13 shown in FIG. 21 is a modified example from the aforesaid Example 12 which was modified such that a first element 3 was provided at two locations within a substantially quadrangular closed loop linear element, and in total, two left and right first feeding points 11, 11' for the closed loop line 4 were provided, respectively, at positions in the vicinity of first feeding points 10, 10', which are feeding points for the two first elements 3, 3'.

One of the two first elements was used as an antenna for portable telephones with a band of 800 MHz, and the other first element 3' was used as an antenna for portable telephones with a band of 2 GHz, whereby the resulting antenna was made as a two-system antenna.

In addition, each of the two feeding points 11, 11' was connected to the closed loop line which is the second element 4 via leading lines which were drawn therefrom, and the closed loop line of the second element 4 is shared by them.

The lengths of the respective first elements 3, 3' were set to a length which corresponds to ¼ of the wavelength of a radio wave to be transmitted and received, and the length of a closed loop portion of the second element 4 was set to a length which corresponds to one and a half the wavelength for the frequency of 800 MHz band and to a length which corresponds to four wavelengths for the 2 GHz band.

After the pattern had been printed on a passenger compartment side of a sheet glass and was then baked thereto to thereby form the pattern on the sheet glass or a seal or sheet on which the pattern was printed was securely affixed to a passenger compartment side of the window glass 1 or the surface of an insulating member such as a resin body.

Assuming that in the two antennas, the wavelength compaction ratio of the glass plate in the frequency of 800 MHz band is 0.6 and the wavelength compaction ratio of the glass plate in the frequency of 2 GHz band is 0.5, the lengths of the two first elements 3, 3' each became ¼ of the wavelength of the transmission and reception radio wave, that is, 55 mm, 18 mm, and the full circumferential overall length of the second element 4 became one and a half the wavelength for the 800 MHz band and four wavelengths for the 2 GHz band, that is, 320 mm.

After the window glass 1 thus produced had been mounted in a side window of a vehicle, an internal conductor line 12*a* and an external conductor line 12*b* of a coaxial cable 12 were connected, respectively, to the first feeding point 10, which is one of the first feeding points, and the second feeding point 11, which is one of the second feeding points, and furthermore, an internal conductor line 12*a* and an external conductor line 12*b* of the coaxial line 12 were connected to the other first feeding point 10' and the other second feeding point 11'.

The respective antennas in which the first elements 3, 3' and the second element 4 are disposed as has been described above was tuned so as to increase reception gains in the portable telephone frequencies of 800 MHz and 2 GHz bands, and as a result, it has been found out that a good transmission and reception performance is obtained and hence that the antennas were good enough to be put to practical use.

FIG. 23 is an example in which an antenna 102 of the invention as shown in FIG. 24 was provided on a side window glass 101 of a vehicle, which is then seen from the outside of the vehicle.

EXAMPLE 14

As shown in FIG. 24, a second feeding point 110 of a horizontally elongated rectangular second element 104 which is an outer element and is formed into a closed loop shape was provided at a position near an upper left-hand side corner of the second element 104.

A first element 103, which is an inner element, was provided as a spiral shape which extends in a clockwise direction from a first feeding point 111 which was provided inside the second element 104 at a position in the vicinity of the second feeding point 110 along an inner side of the second element 104.

An antenna 102 of the invention which is made up of the first element 103 and the second element 104 is an antenna which is effective when used for, in particular, the frequency of 470 to 770 MHz in the UHF bandwidth in the TV broadcast.

The overall length of a line of the second element 104 was one and a half the wavelength of a radio wave to be transmitted and received, that is, assuming that the wavelength compaction ratio of the glass plate in the frequencies of 470 to 770 MHz in the UHF band in the TV broadcast is 0.6, the full circumferential length became about 450 mm in the frequency of 600 MHz, vertical sides a, c were 65 mm long and horizontal sides b, d were 160 mm long.

On the other hand, the overall length of a line of the first element 103 was ⅝ of the wavelength of the reception radio wave, that is, assuming that the wavelength compaction ratio of the glass plate in the frequencies of 470 to 770 MHz in the UHF band in the TV broadcast is 0.6, a length of 390 mm.

As to the overall length of the line of the first element 103, while the overall length was set to a length which corresponds to ⅝ of the wavelength of the reception frequency, in the event that the overall length thereof was attempted to match a length equal to ⅝ wavelengths of a frequency of 580 MHz which is different from the frequency band of the second element 104 in order to increase the gain over a wide band, a good result was obtained.

In addition, spacings between the upper side d of the second element 104 and an upper side of the first element 103 and between the lower side b of the second element 104 and a lower side of the first element 103 were 5 mm, and spacings between the left side a of the second element 104 and a left side of the first element 103 and between the right side c of the second element 104 and a right side of the first element 103 were 10 mm.

Note that the line widths of the respective lines of the first element 103 and the second element 104 were a line width of 1 mm.

Furthermore, a distance between an antenna 102 of the Example thus produced and a flange of a window glass of the vehicle was 15 mm at a nearest portion.

The pattern of the antenna 102 made up of the first element 103 and the second element 104, which are configured as has been described above, was provided on a passenger compartment side of a side window glass 101 of a vehicle as shown in FIG. 23.

The antenna pattern of the invention was screen printed using a conductive paste on the passenger compartment side of the window glass 101 and was then calcined to thereby form a window glass with the antenna. Then, after the window glass 101 so produced had been mounted in a side window of a vehicle, an external conductor line 112*b* of a coaxial cable 112 was connected to the second feeding point 110 and an internal conductor line 112*a* was connected to the first feeding point 111.

Figure 28:
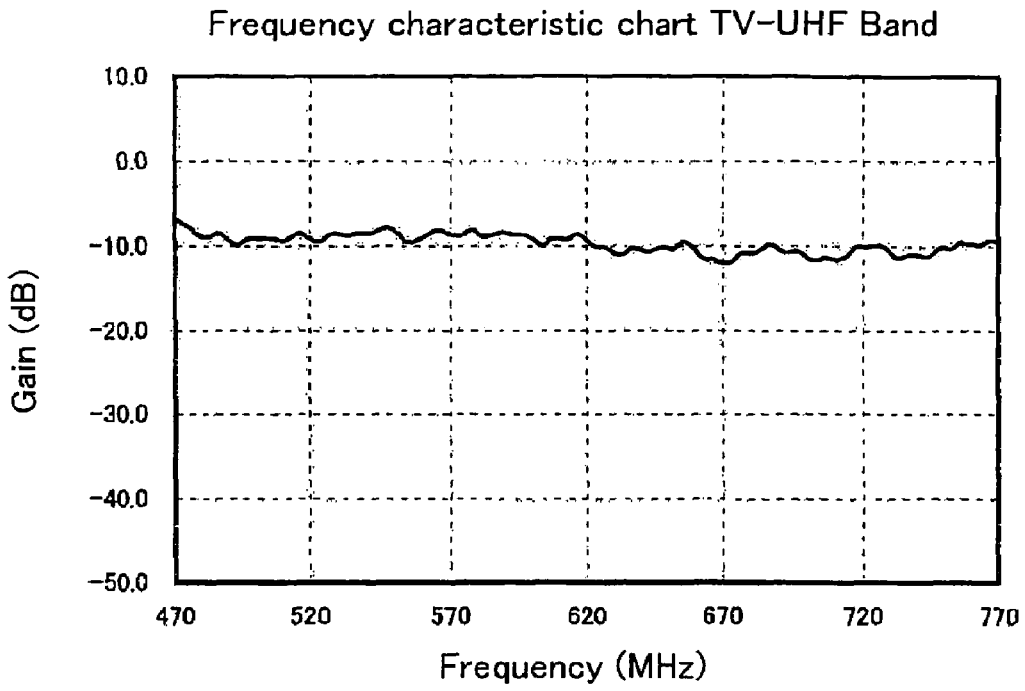
FIG. 28 is a frequency characteristic chart of an antenna gain of Example 14 in the UHF band in the TV broadcast.

The antenna 102 in which the first element 103 and the second element 104 are disposed as has been described above was tuned so as to increase the reception gain in frequencies of 470 to 770 MHz in the UHF band in the TV broadcast, and as result, it has been found out when the result is represented by the dipole ratio that, as is clear from a frequency characteristic chart shown in FIG. 28, a good result of −9.7 dB on the average in the UHF band was obtained which highly exceeds −20.0 dB which is the average of conventional glass antennas which have been in practical use.

In addition, since the antenna shown in FIG. 24 which was obtained as has been described above could provide an antenna which experiences almost no change in antenna impedance even in such a state that there are occupants in the vehicle and which does not deteriorate the field of vision due to the simple construction thereof and the gain thereof is sufficiently high, and hence the antenna so obtained was such as to be good enough to be put to practical use.

EXAMPLE 15

Figure 25:
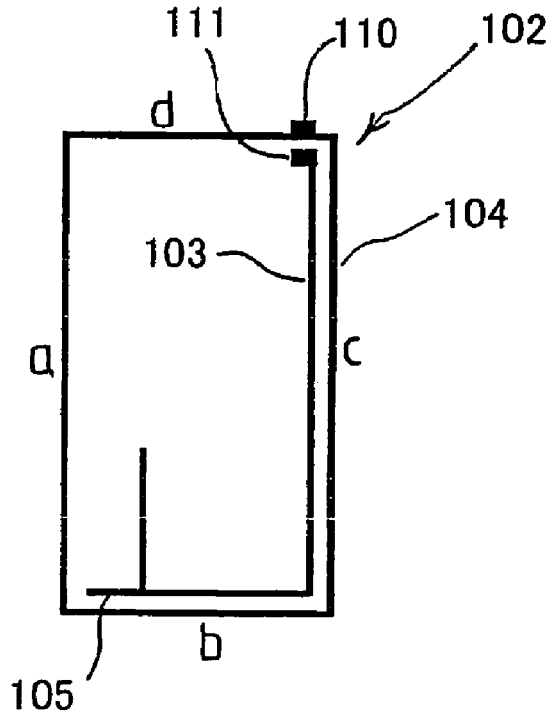
FIG. 25 is a main part detailed front view showing an antenna portion of Example 15 of the invention.

As shown in FIG. 25, this example is a modified example from Example 14 in which a second feeding point 110 of a vertically elongated rectangular second element 104 which is an outer element and is formed into a closed loop shape was provided at a position near an upper right-hand side corner of the second element 104.

A first element 103, which is an inner element, was provided as an L-like shape or U-like shape which extends in a clockwise direction from a first feeding point 111 which was provided inside the second element 104 at a position in the vicinity of the second feeding point 110 along an inner side of the second element 104 and constitutes an antenna which is effective when used in particular for an antenna for a mobile communication band in frequencies of 800 MHz to 960 MHz.

While a horizontal line of the first element 103 which is close to a lower side b of the second element 104 is an element which is mainly formed into a U-like shape which is formed by extending a horizontal line from a right-hand side corner of the lower side of the second element 104 along the same lower side to an intermediate position along the length of the lower side and extending a vertical line upwards from a distal end portion of the horizontal line, an auxiliary line 5 may be provided which branches off a distal end of the horizontal line to extend towards the vicinity of a left-hand side corner of the lower side of the second element 104.

A total length of main constituent lines of the first element 103 was made to correspond to ¾ of the wavelength of radio wave to be transmitted and received.

In addition, the auxiliary line 5 can adjust the impedance of the first element 103.

The overall length of a line of the second element 104 was one and a half the wavelength of the transmission and reception radio wave, that is, assuming that the wavelength compaction ratio of the glass plate in the frequencies of 800 MHz to 960 MHz in the mobile communication is 0.6, the full circumferential length became about 310 mm in the frequency of 850 MHz, vertical sides a, c were 95 mm long and horizontal sides b, d were 65 mm long.

In addition, the overall length of a line of the first element 103 was ¾ of the wavelength of the transmission and reception radio wave, that is, assuming that the wavelength compaction ratio of the glass plate in the frequencies of 800 MHz to 960 MHz is 0.6, was made as a line with a length of 169 mm.

In addition, as to the overall length of the line of the first element 103, while the overall length was set to a length which corresponds to ¾ of the wavelength of the transmission and reception frequency, in the event that the overall length thereof was attempted to match a length equal to about ¾ wavelength of a frequency of 800 MHz which is different from the frequency band of the second element 104 in order to increase the gain over a wide band, a good result was obtained.

In addition, a spacing between the second feeding point 110 and the first feeding point was 3 mm, a spacing between a lower side b of the second element 104 and a lower side of the first element 103 was 3 mm, and a spacing between a right side c of the second element 104 and a right side of the first element 103 was 3 mm, and a spacing between a left side a of the second element 104 and a left side of the first element 103 was 22 mm.

Furthermore, a distance between an antenna 102 thus formed and a flange of a window glass of the vehicle was 15 mm at a nearest portion.

The antenna pattern of the invention is screen printed using a conductive paste on a passenger compartment side of a window glass 101 and was then calcined to thereby form a window glass with the antenna, or a seal or sheet on which the pattern was printed was securely affixed to the passenger compartment side of the window glass 101 or the surface of an insulating member such as a resin body.

After the window glass 101 so produced had been mounted in a side window of a vehicle, an external conductor line 112*b* of a coaxial cable 112 was connected to the second feeding point 110 and an internal conductor line 112*a* was connected to the first feeding point 111.

In addition, while the first element 103 was provided to extend from the first feeding point 111 along an inside of the second element 104 and the overall length of the first element 103 was set to a length corresponding to ¾ of the wavelength of the transmission and reception frequency, here, in order to increase the gain over frequencies of 900 to 960 MHz, the overall length of the first element 103 can be made to match a length equal to ¾ wavelength of a frequency of 900 MHz.

Consequently, assuming that the wavelength compaction ratio of the glass plate in the frequency of 900 MHz is about 0.5, the length of the right side of the element 103 is 89 mm, the length of the bottom side of the element 103 is 40 mm, the length of a portion which is directed upwards from a distal end portion of a horizontal line extended from a right-hand side corner on the lower side of the element 103 along the lower side of the second element 104 is 25 mm, and the whole length forms the U-like shape of 150 mm.

Furthermore, an external conductor line 112*b* of the coaxial cable 112 was connected to the second feeding point 110, and an internal conductor line 112*a* was connected to the first feeding point 111.

The antenna 102 in which the first element 103 and the second element 104 are disposed as has been described above was adjusted with a view to increasing the transmission and reception gain in the frequencies of 800 MHz to 960 MHz in the mobile communication band.

To represent the antenna 102 which was thus arranged by the dipole ratio, when the antenna 102 was tuned so as to increase the transmission and reception gain in the frequencies of 800 MHz to 960 MHz in the mobile communication band, the reception gain became −7.8 on the average, and as a result of this, it has been found out that a good result was obtained which highly exceeds −10.0 dB which is the average of conventional glass antennas which have been in practical use and hence that the antenna was good enough to be put to practical use.

EXAMPLE 16

Example 16 is a modified example in which the pattern of Example 14 was modified, in which a second element 104, which is an outer element, is formed into a substantially rhombic shape which has four corners in upper and lower ends and left and right ends thereof and which is transversely symmetrical, and a second feeding point 110 is provided at a lowermost end position thereof.

A first element 103, which is an inner element, was provided to form a U-like shape which was extended in a clockwise direction from a first feeding point 111 provided at an upper side position which is close to the second feeding point 110 along an inside of the second element 104.

Figure 26:
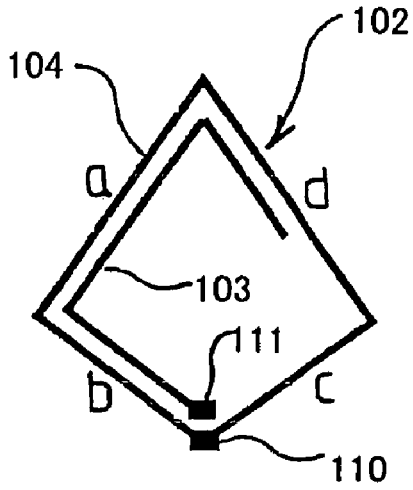
FIG. 26 is a main part detailed front view showing an antenna portion of Example 16 of the invention.

The length of the second element was set to a length corresponding to two wavelengths of radio wave to be transmitted and received, the full circumferential length of the first element 103 was set to a length corresponding to ⅝ wavelengths, and the shape of the second element 104 was formed into a deformed quadrangular shape as shown in FIG. 26, an antenna thus formed constituting an antenna for use as one in frequencies of 1900 to 2200 MHz in the mobile communication. The pattern so formed was printed and baked to a passenger compartment side of a sheet glass or a seal or sheet on which the pattern was printed was securely affixed to a passenger compartment side of a window glass 101 or the surface of an insulating material such a resin body.

Assuming that the wavelength compaction ratio of the glass plate in the frequencies of 1900 to 220 MHz is about 0.6, the length of the second element 104 became two wavelengths of radio wave to be transmitted and received, that is, the full circumferential length thereof became about 154 mm in a frequency of 1950 MHz, upper left and right inclined sides a, d were 46 mm long, lower left and right inclined sides b, c were 31 mm long, the second element was thus formed into the deformed quadrangular shape with a full circumferential length of 154 mm, and the full circumferential overall length of the first element 103 was a length equal to ⅝ wavelengths, that is, about 89 mm here for a frequency of 2100 MHz.

After the window glass 101 so produced had been mounted in a side window of a vehicle, an external conductor line 112*b* of a coaxial cable 112 was connected to the second feeding point 110 and an internal conductor line 112*a* was connected to the first feeding point 111.

The antenna 102 in which the first element 103 and the second element 104 are disposed as has been described above was adjusted with a view to increasing the transmission and reception gain of the antenna in the frequencies of 1900 to 2200 MHz in the mobile communication band. As a result, it has been found out that a good transmission and reception performance that the average reception gain is −8.2 dB was obtained and that the antenna was good enough to be put to practical use.

EXAMPLE 17

Figure 27:
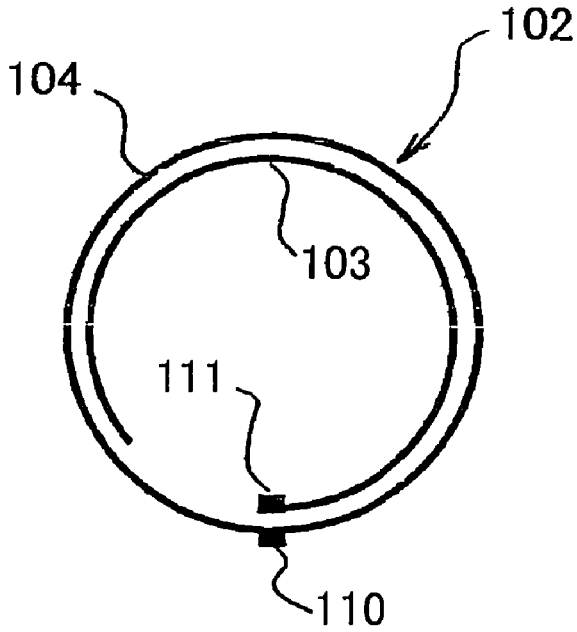
FIG. 27 is a main part detailed front view showing an antenna portion of Example 17 of the invention.

As shown in FIG. 27, a second element 104, which is an outer element, is a circular linear element, and a second feeding point 110 is provided at a lowermost end position of the circular linear element.

A first element 103, which is an inner element, was provided to form an arc-like shape resulting by cutting part a circular shape which was extended in a counterclockwise direction from a first feeding point 111 provided at an upper side position which is close to the second feeding point 110 along an inside of the second element 104.

The length of the second element 104 was set to a length corresponding to one wavelength of radio wave to be transmitted and received, the full circumferential length of the first element 103 was set to a length corresponding to ¾ wavelength, and furthermore, the shape of the second element 104 was formed into a circular shape as shown in FIG. 27 and the shape of the first element 103 was formed into the arc-like shape resulting by cutting part of a circular shape, an antenna thus formed constituting an antenna for use as one in frequencies of 170 to 230 MHz in the VHF-HIGH band in the TV broadcast. The pattern so formed was printed and baked to a passenger compartment side of a sheet glass or a seal or sheet on which the pattern was printed was securely affixed to a passenger compartment side of a window glass 101 or the surface of an insulating material such a resin body, and thereafter, an external conductor line 112*b* of a coaxial cable 112 was connected to the second feeding point 110 and an internal conductor line 112*a* was connected to the first feeding point 111.

Assuming that the wavelength compaction ratio of the glass plate in the frequencies of 170 to 230 MHz in the VHF-HIGH band in the TV broadcast is about 0.6, the length of the second element 104 became one wavelength of radio wave to be transmitted and received, that is, the full circumferential length thereof became about 1040 mm in a frequency of 200 MHz, and the full circumferential overall length of the first element 103 was a length equal to ¾ wavelength, that is, about 750 mm here for a frequency of 210 MHz, which covers the arc-like shape of the first element 103.

The antenna 102 in which the first element 103 and the second element 104 are disposed as has been described above was tuned with a view to increasing the reception gain in the frequencies of 170 to 230 MHz in the TV broadcast.

To represent the antenna shown in FIG. 27 by the dipole antenna ration, the reception gain became −10.1 dB on the average in the VHF-HIFH band, and thus, a good result was obtained which highly exceeds −18.0 dB which is the average of conventional glass antennas which are in practical use.

While the invention has been described in detail by reference to the specific examples, it is apparent to those skilled in the art that the invention can be changed and modified in various ways without departing from the spirit and scope of the invention.

The present application claims priority based on Japanese Patent Application (Patent Application No. 2003-74837) filed on Mar. 19, 2003, the Japanese Patent Application (Patent Application No. 2003-394328) filed on Nov. 25, 2003, the Japanese Patent Application (Patent Application No. 2004-007353) filed on Jan. 14, 2004 and the Japanese Patent Application (Patent Application No. 2004-032659) filed on Feb. 9, 2004, and the contents of these Japanese Patent Applications are incorporated herein by reference.

INDUSTRIAL APPLICATION

Thus, while the invention has been described by reference to the preferred examples, the invention is not limited thereto but can be applied to other various applications.

In addition, by appropriately selecting line widths of 20 mm or smaller or preferably from a range of 0.1 to 10 mm for the lines of the first element 3 and the second element 4, there can be provided a function to increase the gain with respect to a wide range of frequencies, thereby making it possible to obtain an antenna with a wide band.

In addition, by appropriately selecting line widths of 20 mm or smaller or preferably from a range of 0.1 to 10 mm for the lines of the first element 103 and the second element 104, there can be provided a function to increase the gain with respect to a wide range of frequencies, thereby making it possible to obtain an antenna with a wide band.

In addition, the invention can preferably be used in transmitting and receiving radio waves of very-high-frequencies and ultrahigh frequencies such as for personal radio communications, commercial radio communications and PHS.

In addition, the antenna of the invention is used by directly printing its antenna patterns on a window glass surface of a rear window glass at upper and lower portions remaining unused for defogger heater lines, a windshield, a side window glass and a roof window glass or by printing the same on a film-like seal or sheet so as to be securely affixed to a passenger compartment side of the window glass or an insulating body member of a movable body.

In addition, while the antenna of the invention can be used independently, more preferable effects can be obtained when the antenna is used as those glass antennas, seal antennas in which the antenna is printed on a seal or sheet so as to be securely affixed to an insulating member of the movable body or is used together with a rod antenna for diversity reception.

In addition, while in the examples of the antenna of the invention, the feeding terminals of the antenna 2 and a tuner, not shown, are described as being connected to each other with a coaxial cable, in the event that an impedance matching circuit and a circuit such as an amplifier, which are not shown, are interposed for connection between the feeding terminals of the antenna 2 and the tuner, much more preferable effects can be obtained.

The invention claimed is:

1. A vehicular antenna which is a line antenna provided on a surface of an insulating member of a movable body, the vehicular antenna comprising:

a first element extended from a first feeding point and having a length of ¼, ¾ or ⅝ of a wavelength of transmission and reception radio wave; and a second element formed into a closed loop which is extended from a second feeding point provided in the vicinity of the first feeding point so as to surround the first element, and having a length equal to or greater than one wavelength of the transmission and reception radio wave, wherein the first element and the second element are connected to a single coaxial cable, an internal conductor line of the coaxial cable is connected to the first feeding point, and an external conductor line of the coaxial cable is connected to the second feeding point.

2. The vehicular antenna according to claim 1, wherein a linear portion extended from the first feeding point of the first element includes:

a first linear portion extending close to a closed loop line of the second element with a length of ⅛ or less of the wavelength of the transmission and reception radio wave for a capacity coupling; and a second linear portion extending from a distal end of the first linear portion in a direction in which the second linear portion extends away from the second element.

3. The vehicular antenna according to claim 2, wherein the first linear portion extending from the first feeding point of the first element with the length of ⅛ or less of the wavelength of the transmission and reception radio wave is close to the second element with a spacing of 0.1 to 10 mm.

4. The vehicular antenna according to claim 1, wherein a portion spaced apart along a linear portion extended from the second feeding point of the second element by ¼ of the wavelength of the transmission and reception radio wave is provided apart from the opposite end portion to the first feeding point of the first element by 1/32 or more of the wavelength.

5. The vehicular antenna according to claim 1, wherein the second feeding point is provided at a distal end of a leading line along the closed loop, and the length of the leading line is ¼ or less of the wavelength of the transmission and reception radio wave.

6. The vehicular antenna according to claim 1, wherein a length of a linear portion of the closed loop of the second element is equal to or greater than one wavelength of the transmission and reception radio wave but not in excess of four wavelengths.

7. The vehicular antenna according to claim 6, wherein the wavelength of the transmission and reception radio wave is $\lambda$, and the length of the linear portion of the closed loop of the second element is $(1+n/2)\lambda$ (n is an integer of 0 to 6).

8. The vehicular antenna according to claim 1, wherein first elements are provided at a plurality of locations inside the second element formed into the closed loop, and respective first feeding points of the plurality of first elements are positioned in the vicinity of second feeding points of the second element.

9. The vehicular antenna according to claim 1, wherein the second element is formed into a closed loop of a polygonal or arc-like shape.

10. The vehicular antenna according to claim 1, wherein the length of the first element is ¾ of the wavelength of the transmission and reception radio wave, and a spacing between the first element and the second element at a portion linearly extended from the first feeding point by a length of ½ of the wavelength of the transmission and reception radio wave is 0.5 to 10 mm.

11. The vehicular antenna according to claim 1, wherein the length of the first element is ⅝ of the wavelength of the transmission and reception radio wave, and a spacing between the first element and the second element at a portion linearly extended from the first feeding point by one wavelength of the transmission and reception radio wave is 0.5 to 10 mm.

12. The vehicular antenna according to claim 1, wherein the length of the second element is longer by ¼ or more of the wavelength of the transmission and reception radio wave than the length of the first element.

13. The vehicular antenna according to claim 1, wherein the wavelength of the transmission and reception radio wave is $\lambda$, and the length of the second element is $(1+n/2)\lambda$ (n is an integer of 0 to 4).

14. The vehicular antenna according to claim 1, wherein a pattern of the antenna elements is directly printed using a conductive ceramic paste on the surface of an insulating member of the movable body.

15. The vehicular antenna according to claim 1, wherein a pattern of the antenna elements is printed on a seal, and the seal is affixed on the surface of an insulating member of the movable body.

16. The vehicular antenna according to claim 1, wherein a pattern of the antenna elements is printed on a sheet, and the sheet is affixed on the surface of an insulating member of the movable body.

17. The vehicular antenna according to claim 1, the first element does not cross the second element.

18. The vehicular antenna according to claim 1, wherein the first feeding point is arranged inside of the closed loop, an opposite end portion to the first feeding point of the first element is arranged inside of the closed loop, and the first element does not cross the second element.

19. A vehicular antenna which is a line antenna provided on a surface of an insulating member of a movable body, the vehicular antenna comprising:

a first element extended from a first feeding point and having a length of ¼, ¾ or ⅝ of a wavelength of transmission and reception radio wave; and a second element formed into a closed loop which is extended from a second feeding point provided in the vicinity of the first feeding point so as to surround the first element, and having a length equal to or greater than one wavelength of the transmission and reception radio wave, wherein a metallic terminal is placed on at least one of the first feeding point and the second feeding point, and one of the feeding points or the metallic terminal is placed close to the other of the feeding points or the metallic terminal.

* * * * *